US012638241B2

(12) United States Patent
Daikai

(10) Patent No.: US 12,638,241 B2
(45) Date of Patent: May 26, 2026

(54) DOUBLE-TUBE HEAT EXCHANGER AND MANUFACTURING METHOD THEREFOR

(71) Applicant: Sumitomo Riko Company Limited, Aichi (JP)

(72) Inventor: Eiichi Daikai, Aichi (JP)

(73) Assignee: Sumitomo Riko Company Limited, Aichi (JP)

( * ) Notice: Subject to any disclaimer, the term of this patent is extended or adjusted under 35 U.S.C. 154(b) by 189 days.

(21) Appl. No.: 18/330,350

(22) Filed: Jun. 6, 2023

(65) Prior Publication Data

US 2023/0341188 A1 Oct. 26, 2023

Related U.S. Application Data

(63) Continuation of application No. PCT/JP2022/027442, filed on Jul. 12, 2022.

(30) Foreign Application Priority Data

Jul. 29, 2021 (JP) ..... 2021-124294

(51) Int. Cl.
*F28D 7/10* (2006.01)
*F28F 1/16* (2006.01)
*F28F 1/22* (2006.01)

(52) U.S. Cl.
CPC ..... *F28D 7/106* (2013.01); *F28F 1/16* (2013.01); *F28F 1/22* (2013.01)

(58) Field of Classification Search
CPC ..... F28D 7/106
See application file for complete search history.

(56) References Cited

U.S. PATENT DOCUMENTS 1,005,441 A * 10/1911 Lovekin ..... F28D 7/106 122/271
2011/0174469 A1* 7/2011 Kim ..... F28F 1/426 165/154

(Continued)

FOREIGN PATENT DOCUMENTS

JP 85832275 3/1983
JP H1038491 2/1998

(Continued)

OTHER PUBLICATIONS

"Written Opinion of the International Searching Authority (Form PCT/ISA/237) of PCT/JP2022/027442", mailed on Sep. 20, 2022, with English translation thereof, pp. 1-11.

(Continued)

*Primary Examiner* — Eric S Ruppert
(74) *Attorney, Agent, or Firm* — JCIPRNET

(57) ABSTRACT

The double-tube heat exchanger has an outer tube and an inner tube inserted into the outer tube, is provided with an inside channel within the inner tube and an outside channel between the inner tube and the outer tube, and is configured to exchange heat between the fluid flowing in the inside channel and the fluid flowing in the outside channel. The inner tube has an uneven portion having unevenness on the outer peripheral surface. A large-diameter sealing portion is interposed between one axial end of the outer tube and the inner tube. A small-diameter sealing portion, which has a smaller diameter than the large-diameter sealing portion, is interposed between the other axial end of the outer tube and the inner tube. The outside channel and the uneven portion are arranged using the difference in axial position and diameter between the large-diameter sealing portion and the small-diameter sealing portion.

12 Claims, 11 Drawing Sheets

(56) References Cited

U.S. PATENT DOCUMENTS

| | | | |
|---|---|---|---|
| 2018/0045467 | A1 | 2/2018 | Lee et al. |
| 2020/0248845 | A1 | 8/2020 | Cho |

FOREIGN PATENT DOCUMENTS

| | | | | | |
|---|---|---|---|---|---|
| JP | 2000130964 | A | * | 5/2000 | ..... F28D 7/106 |
| JP | 2002318015 | | | 10/2002 | |
| JP | 2006162238 | | | 6/2006 | |
| JP | 2014009831 | | | 1/2014 | |
| JP | 2018025374 | | | 2/2018 | |
| JP | 2020109329 | | | 7/2020 | |
| JP | 2020531789 | | | 11/2020 | |
| KR | 20090029891 | A | * | 3/2009 | ..... B60H 1/00321 |
| KR | 20110084720 | A | * | 7/2011 | |
| KR | 1020130001544 | | | 1/2013 | |
| KR | 1020140054864 | | | 5/2014 | |

OTHER PUBLICATIONS

"International Search Report (Form PCT/ISA/210) of PCT/JP2022/027442", mailed on Sep. 20, 2022, with English translation thereof, pp. 1-6.
"Search Report of Europe Counterpart Application", issued on Jul. 26, 2024, pp. 1-7.
"Office Action of Europe Counterpart Application", issued on Apr. 15, 2025, p. 1-p. 5.
"Notice of Reasons for Refusal of Japan Counterpart Application", issued on Jun. 17, 2025, with English translation thereof, p. 1-p. 11.

* cited by examiner

DOUBLE-TUBE HEAT EXCHANGER AND MANUFACTURING METHOD THEREFOR

CROSS-REFERENCE TO RELATED APPLICATION

The present application is a continuation of PCT/JP2022/027442, filed on Jul. 12, 2022, and is related to and claims priority from Japanese Patent Application No. 2021-124294, filed on Jul. 29, 2021. The entire contents of the aforementioned application are hereby incorporated by reference herein.

TECHNICAL FIELD

The present disclosure relates to a double-tube heat exchanger used in, for example, an air conditioner and a manufacturing method therefor.

RELATED ART

Patent Literatures 1 to 4 (Japanese Patent Laid-Open No. 2006-162238, 2018-025374, 2020-109329, and 2002-318015) disclose double-tube heat exchangers. A double-tube heat exchanger is provided with an outer tube and an inner tube. The inner tube is arranged radially inside the outer tube. An inside channel is formed inside the inner tube. An outside channel is formed between the inner tube and the outer tube. A spiral portion is arranged on a tube wall of the inner tube.

The double-tube heat exchanger is used, for example, in a refrigeration cycle of a vehicle air conditioner. The inside channel of the double-tube heat exchanger is arranged between an evaporator and a compressor in the refrigeration cycle. The outside channel is arranged between a condenser and an expansion valve. Heat is exchanged between a low-pressure refrigerant flowing through the inside channel and a high-pressure refrigerant flowing through the outside channel via the spiral portion of the inner tube.

Both axial ends of the outside channel of the double-tube heat exchanger are fluid-tightly sealed by sealing portions (connecting portions between the outer tube and the inner tube). In the case of the double-tube heat exchangers of Patent Literatures 1 to 4, both sealing portions have the same diameter. Therefore, it is difficult to arrange the outside channel and the spiral portion by using the difference in diameter between the two sealing portions. Consequently, the structure tends to be complicated. Further, in the case of the double-tube heat exchangers of Patent Literatures 1 to 4, both sealing portions have the same diameter so the inner tube tends to interfere with the outer tube when the inner tube is inserted into the outer tube. Therefore, the assemblability between the inner tube and the outer tube is low. The present disclosure provides a double-tube heat exchanger that has a simple structure and high assemblability between the inner tube and the outer tube, and a manufacturing method therefor.

SUMMARY

The present disclosure provides a double-tube heat exchanger which includes: an outer tube; and an inner tube inserted into the outer tube. The double-tube heat exchanger is provided with an inside channel inside the inner tube and provided with an outside channel between the inner tube and the outer tube, and the double-tube heat exchanger is configured to exchange heat between a fluid flowing through the inside channel and a fluid flowing through the outside channel. The inner tube includes an uneven portion having unevenness on an outer peripheral surface. A large-diameter sealing portion is interposed between one axial end of the outer tube and the inner tube. A small-diameter sealing portion having a smaller diameter than the large-diameter sealing portion is interposed between the other axial end of the outer tube and the inner tube. The outside channel and the uneven portion are arranged by using a difference in axial position and a difference in diameter between the large-diameter sealing portion and the small-diameter sealing portion.

Further, the present disclosure provides a manufacturing method for a double-tube heat exchanger, which includes: an outer tube; and an inner tube inserted into the outer tube. The double-tube heat exchanger is provided with an inside channel inside the inner tube and provided with an outside channel between the inner tube and the outer tube, and the double-tube heat exchanger is configured to exchange heat between a fluid flowing through the inside channel and a fluid flowing through the outside channel. According to an insertion direction front side being a front side and an insertion direction rear side being a rear side, when the inner tube is inserted into the outer tube, the inner tube includes an uneven portion having unevenness on an outer peripheral surface, a large-diameter sealing portion is interposed between a rear end portion of the outer tube and the inner tube, and a small-diameter sealing portion having a smaller diameter than the large-diameter sealing portion is interposed between a front end portion of the outer tube and the inner tube. The manufacturing method includes: inserting a front end of the inner tube into a rear end of the outer tube; positioning the inner tube and the outer tube by moving the inner tube forward relative to the outer tube after insertion; and forming the large-diameter sealing portion by connecting the rear end portion of the outer tube and the inner tube after positioning, and forming the small-diameter sealing portion by connecting the front end portion of the outer tube and the inner tube after positioning.

Here, the "connection" in the "sealing step" includes a form in which the outer tube (rear end portion, front end portion) and the inner tube are directly connected (for example, a form in which the outer tube and the inner tube are connected by crimping, bonding, welding, brazing, etc.), and a form in which the outer tube and the inner tube are indirectly connected (for example, a form in which the outer tube and the inner tube are connected via a sealing member).

In the double-tube heat exchanger of the present disclosure, a space resulting from a difference in axial position between the large-diameter sealing portion and the small-diameter sealing portion and a difference in diameter between the large-diameter sealing portion and the small-diameter sealing portion is secured. With the double-tube heat exchanger of the present disclosure, it is possible to arrange at least a part of the outside channel and at least a part of the uneven portion by using the space. Thus, the structure of the double-tube heat exchanger is simplified.

Further, according to the manufacturing method for the double-tube heat exchanger of the present disclosure, it is possible to easily insert the front end of the inner tube into the rear end of the outer tube by using the difference in diameter between the large-diameter sealing portion and the small-diameter sealing portion. Thus, it is possible to improve the assemblability between the inner tube and the outer tube.

Figure 6:
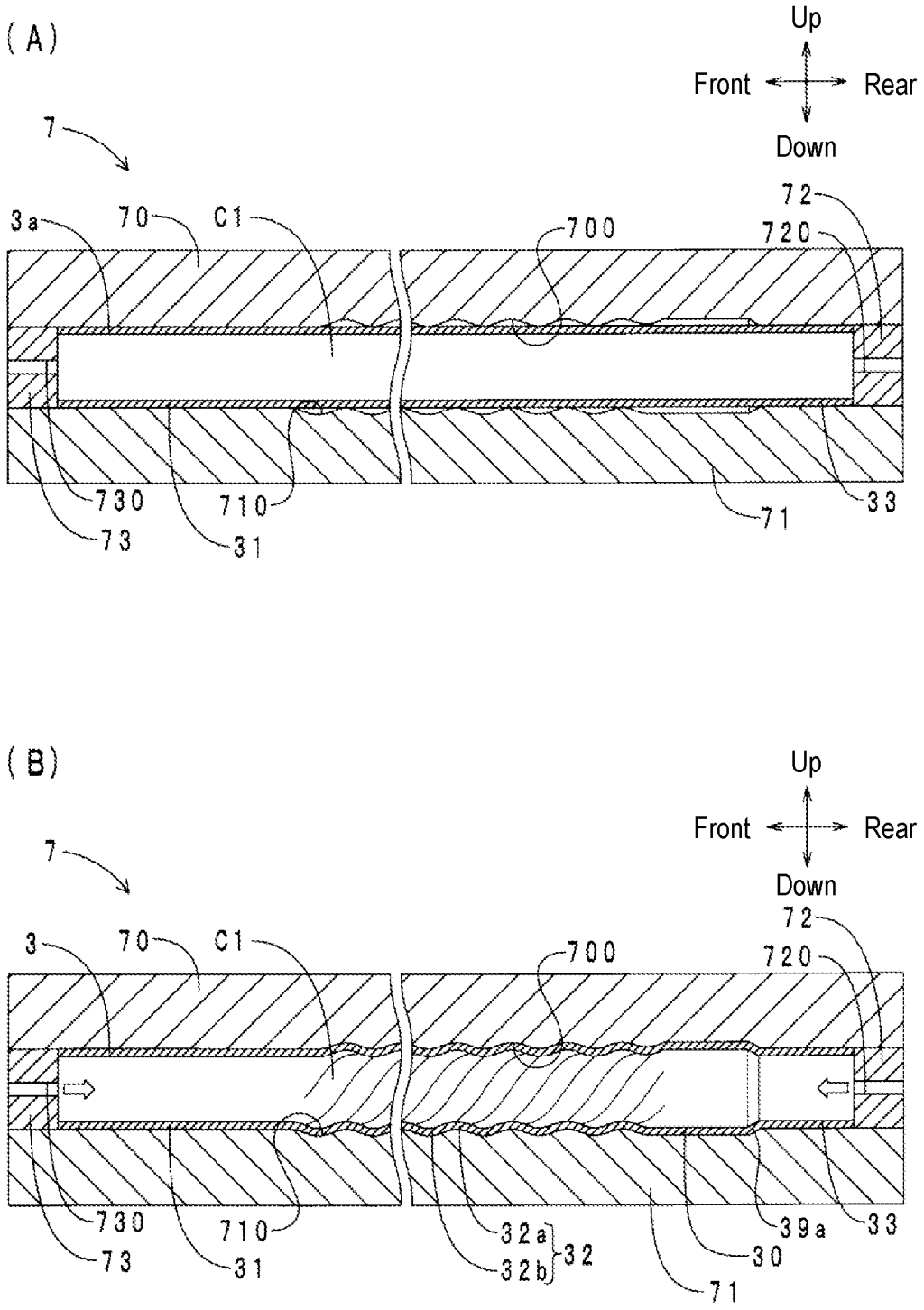

(A) of FIG. 6 is a front-rear direction cross-sectional view of the mold in the inner tube molding step (initial stage) of the manufacturing method for the double-tube heat exchanger. (B) of FIG. 6 is a front-rear direction cross-sectional view of the mold in the same step (final stage).

Figure 7:
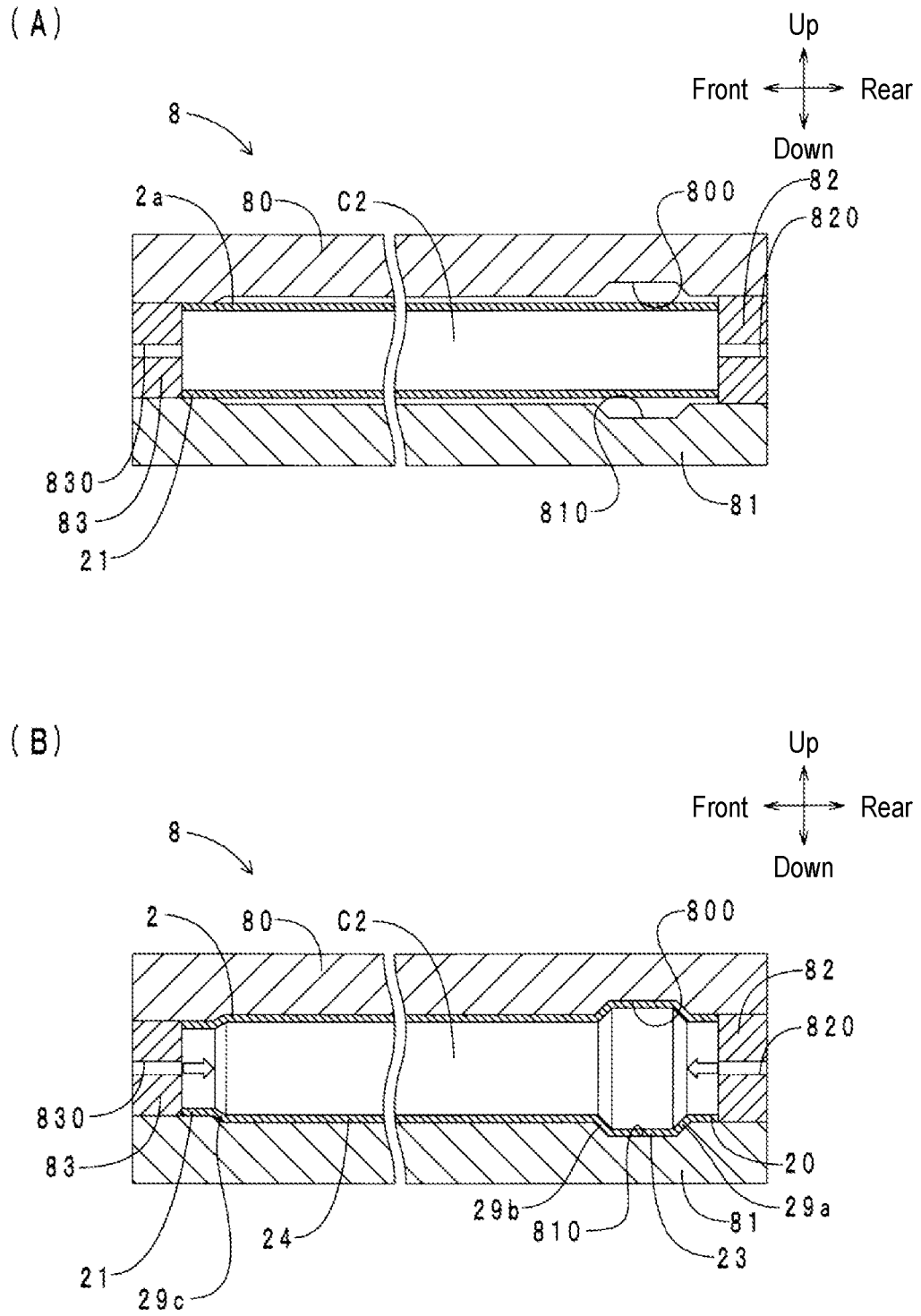

(A) of FIG. 7 is a front-rear direction cross-sectional view of the mold in the outer tube molding step (initial stage) of the manufacturing method. (B) of FIG. 7 is a front-rear direction cross-sectional view of the mold in the same step (final stage).

Figure 8:
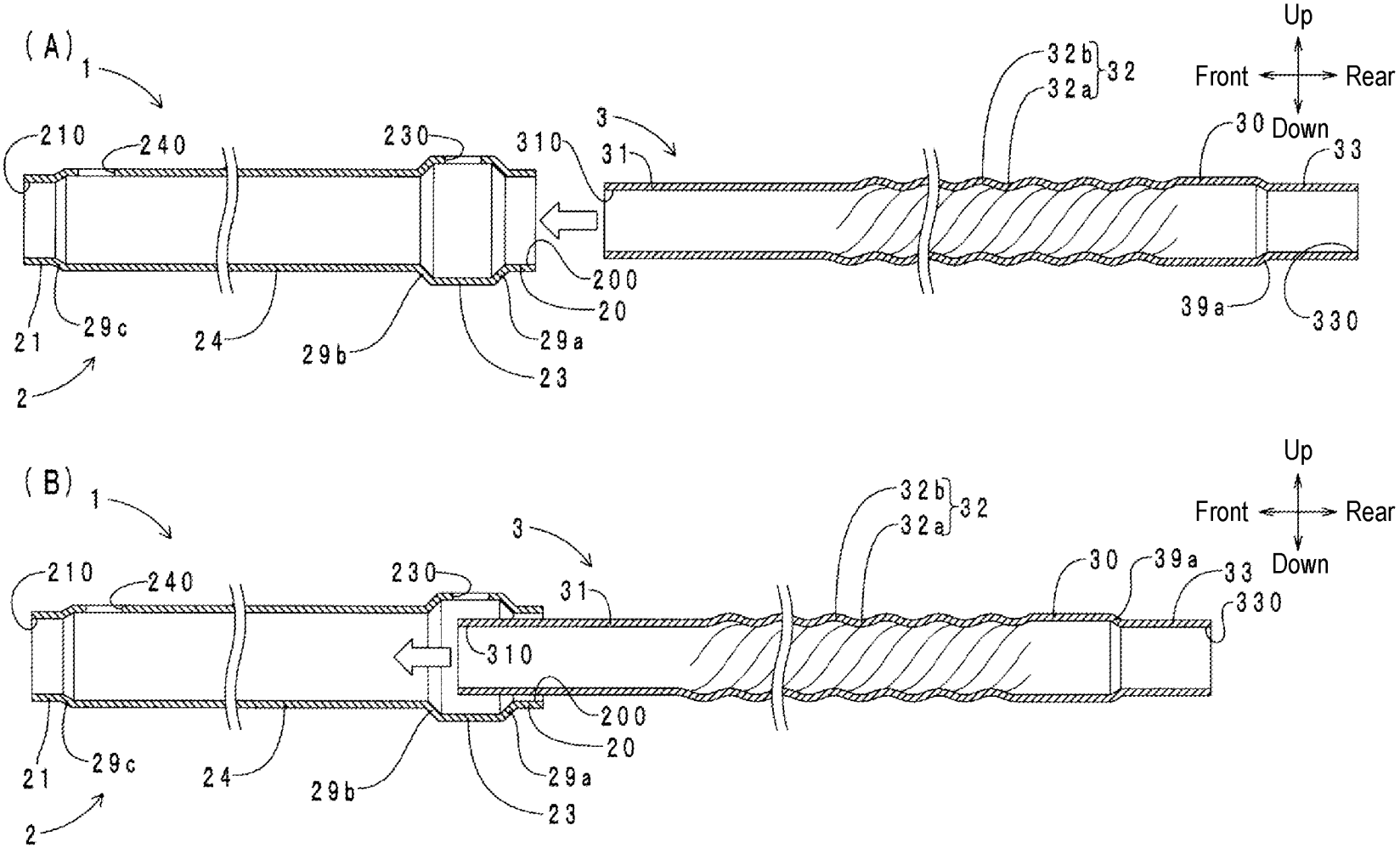

(A) of FIG. 8 is a front-rear direction cross-sectional view of the inner tube and the outer tube in the inserting step (initial stage) of the manufacturing method. (B) of FIG. 8 is a front-rear direction cross-sectional view of the inner tube and the outer tube in the same step (final stage) and the positioning step (initial stage).

Figure 9:
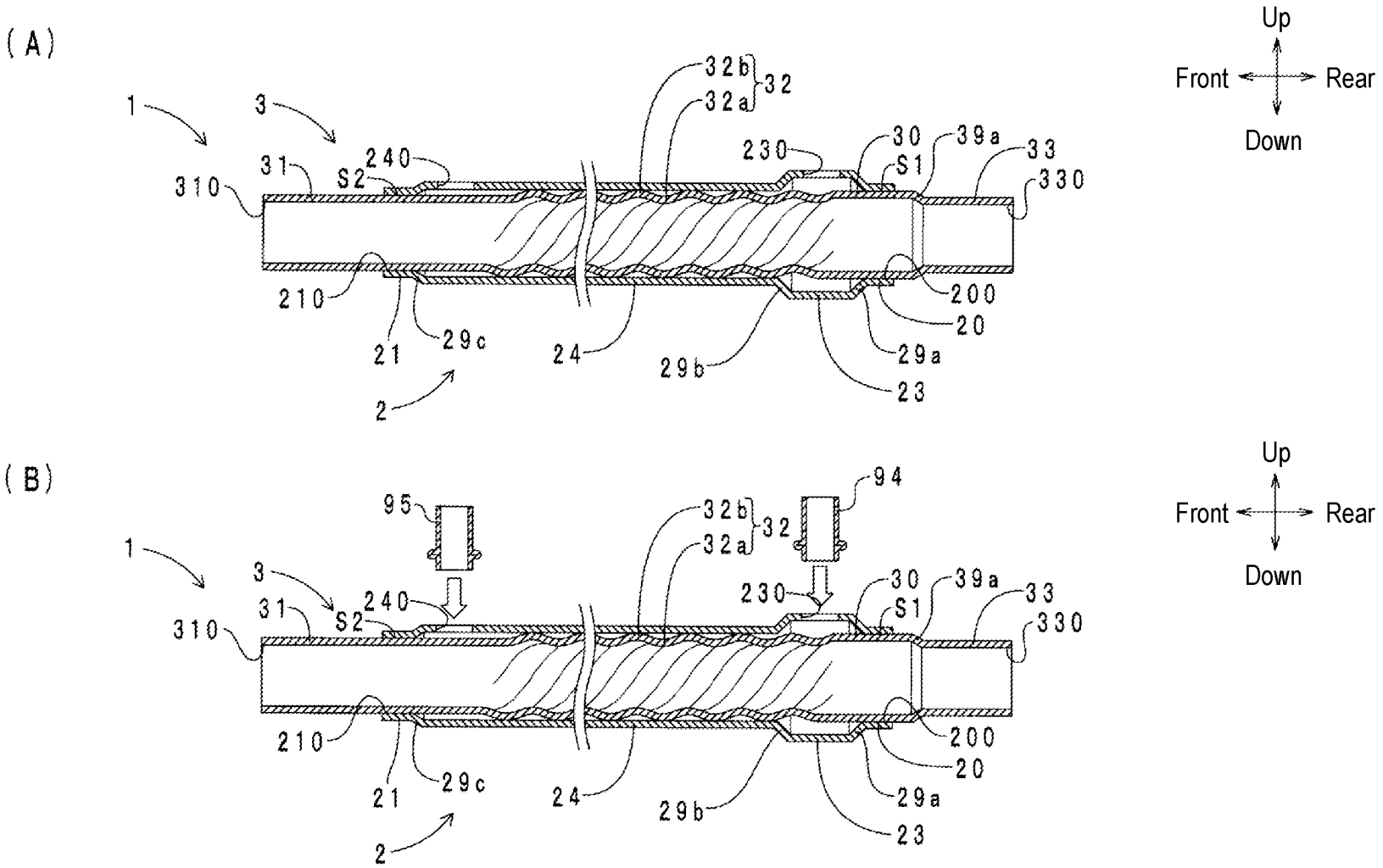

(A) of FIG. 9 is a front-rear direction cross-sectional view of the inner tube and the outer tube in the positioning step (final stage) and the sealing step of the manufacturing method. (B) of FIG. 9 is a front-rear direction cross-sectional view of the inner tube and the outer tube in the pipe connecting step of the manufacturing method.

Figure 10:
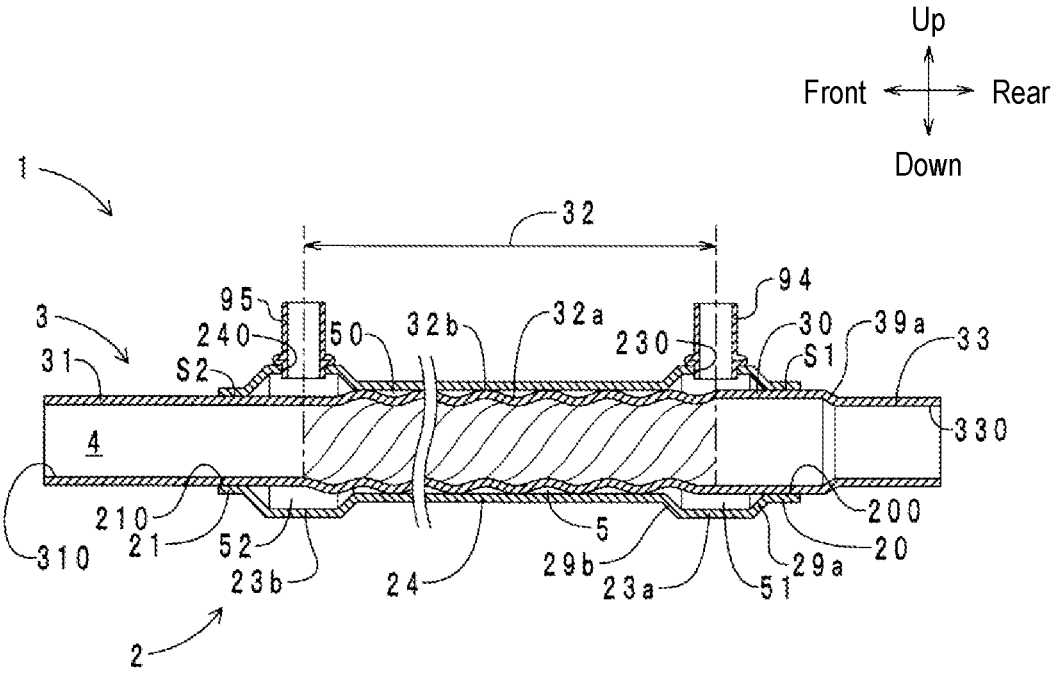

FIG. 10 is a front-rear direction cross-sectional view of the double-tube heat exchanger of the second embodiment.

Figure 11:
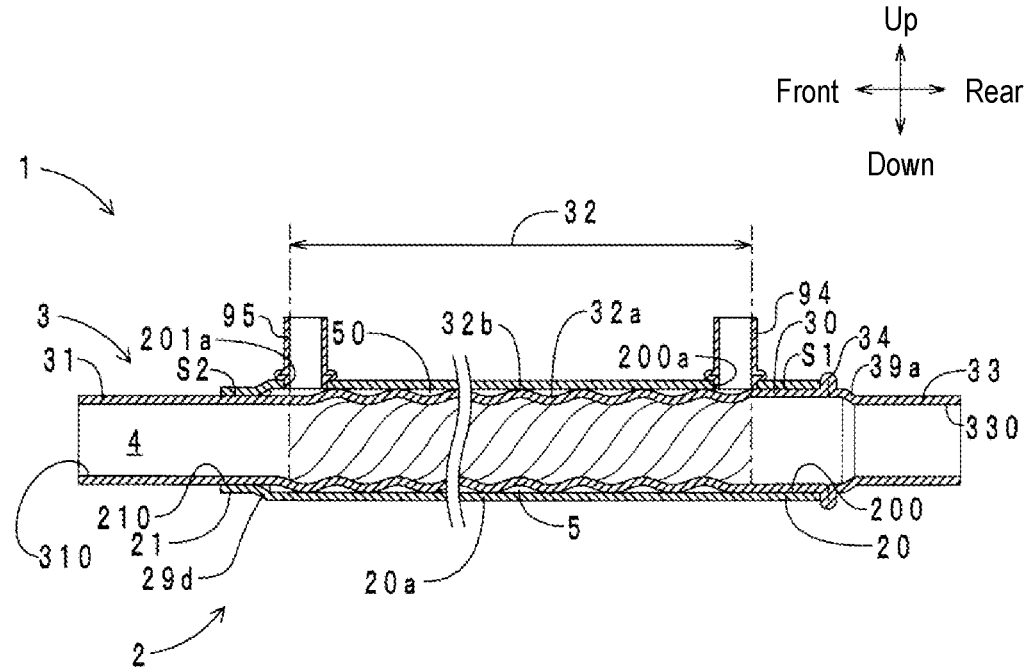

FIG. 11 is a front-rear direction cross-sectional view of the double-tube heat exchanger of the third embodiment.

Figure 12:
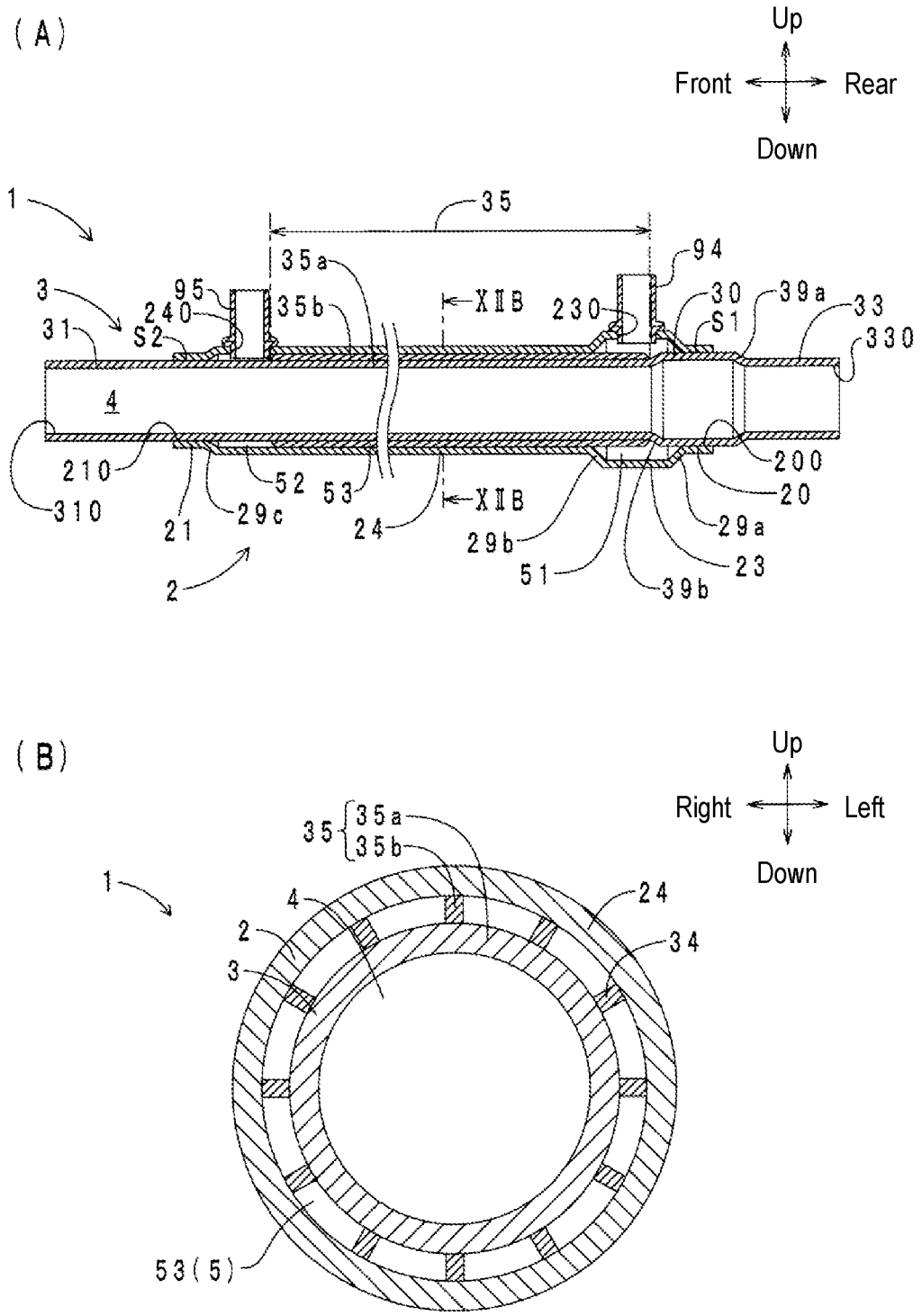

(A) of FIG. 12 is a front-rear direction cross-sectional view of the double-tube heat exchanger of the fourth embodiment. (B) of FIG. 12 is a cross-sectional view along the direction XIIB-XIIB of (A) of FIG. 12.

Figure 13:
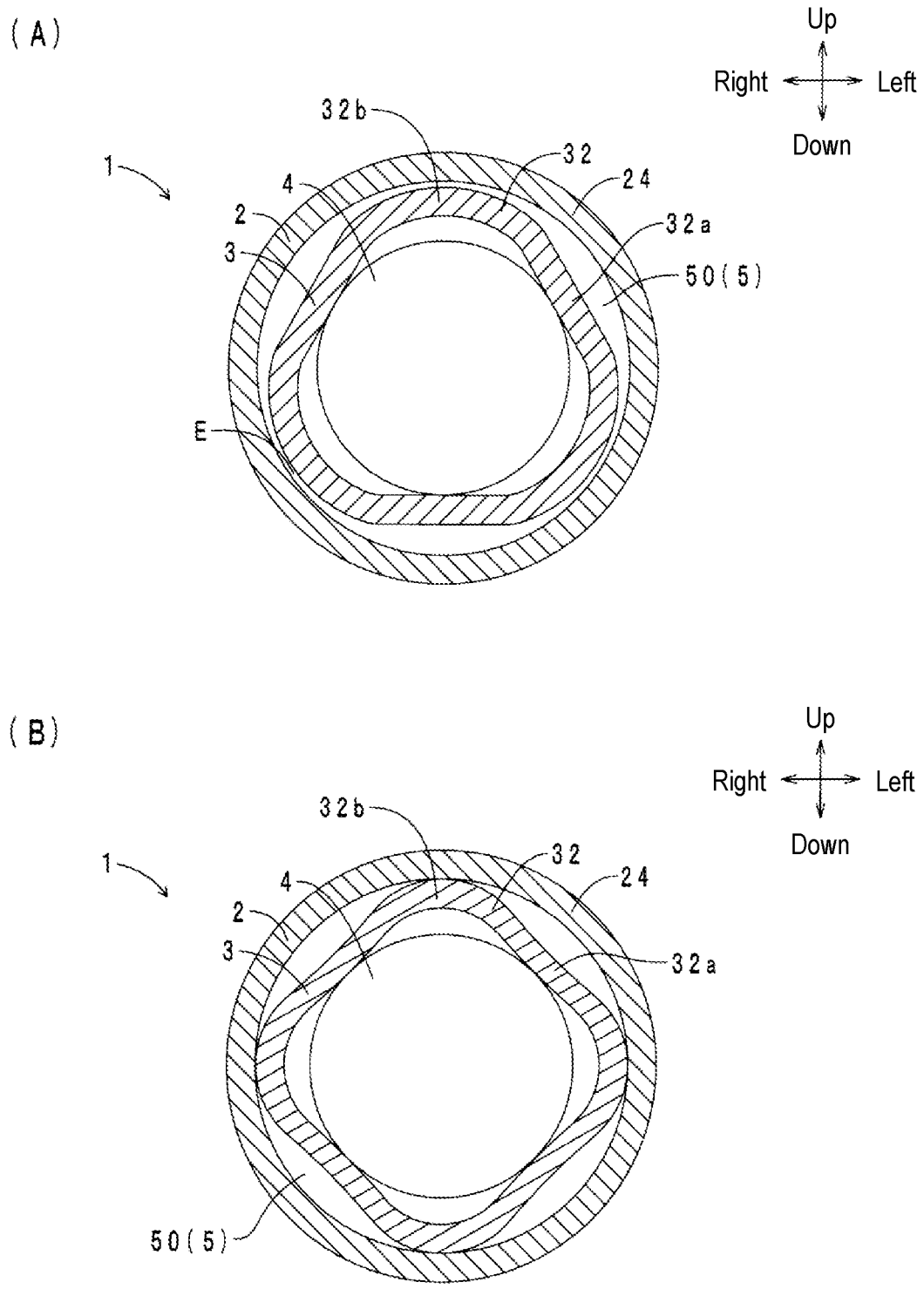

(A) of FIG. 13 is a radial direction cross-sectional view of the double-tube heat exchanger of another embodiment (No. 1). (B) of FIG. 13 is a radial direction cross-sectional view of the double-tube heat exchanger of another embodiment (No. 2).

DESCRIPTION OF EMBODIMENTS

Embodiments of a double-tube heat exchanger and a manufacturing method therefor according to the present disclosure will be described below.

First Embodiment

[Configuration of Heat Pump Cycle]

Figure 1:
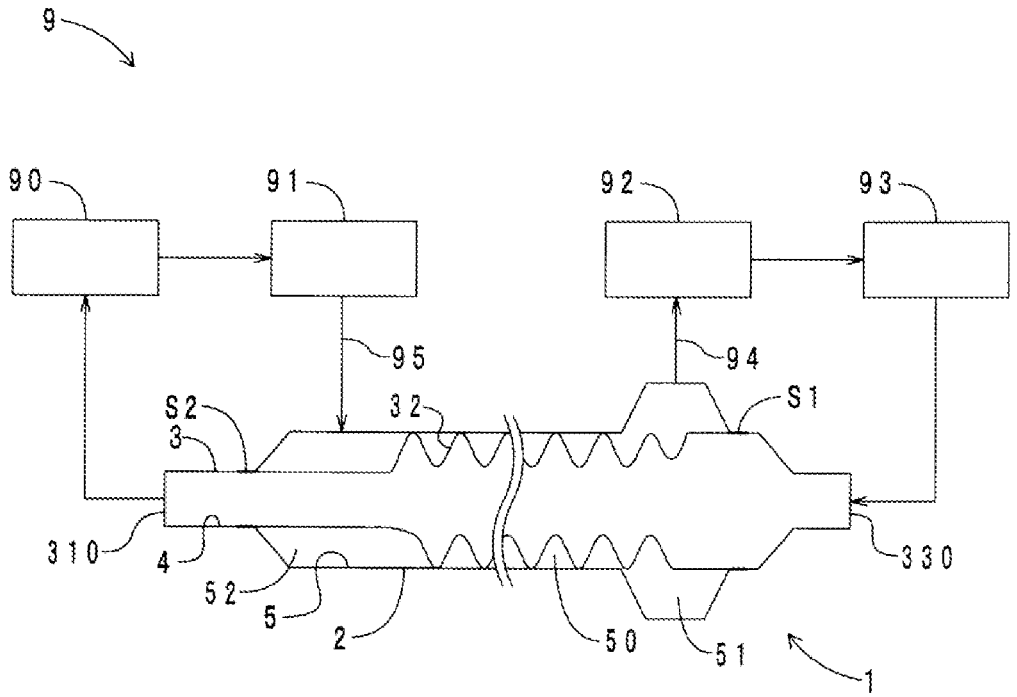
FIG. 1 is a schematic diagram of a heat pump cycle of a vehicle air conditioner in which the double-tube heat exchanger of the first embodiment is arranged.

First, the configuration of a heat pump cycle of a vehicle air conditioner in which the double-tube heat exchanger of the present embodiment is arranged will be described. FIG. 1 shows a schematic diagram of the heat pump cycle of the vehicle air conditioner in which the double-tube heat exchanger of the present embodiment is arranged.

The heat pump cycle 9 includes a compressor 90, a condenser (vehicle exterior heat exchanger) 91, an expansion valve (expander) 92, and an evaporator (vehicle interior heat exchanger) 93. During cooling, a refrigerant (heat medium) circulates through the heat pump cycle 9 in the order of compressor 90→condenser 91→expansion valve 92→evaporator 93→compressor 90 again. The refrigerant is included in the concept of "fluid" of the present disclosure.

The compressor 90 compresses the refrigerant to a high temperature and a high pressure by a driving force from a driving source (engine, battery, etc.) of a vehicle. The condenser 91 condenses and liquefies the refrigerant through heat exchange with the outside air. The expansion valve 92 decompresses and expands the refrigerant is enthalpically. The evaporator 93 evaporates the refrigerant through heat exchange with the interior of the vehicle. At this time, the air in the interior of the vehicle is cooled by the latent heat of evaporation of the refrigerant. Thus, during cooling, the heat pump cycle 9 absorbs heat from the interior of the vehicle via the refrigerant and discharges the heat to the outside of the vehicle. The double-tube heat exchanger 1 of the present embodiment constitutes a part of the piping of the heat pump cycle 9.

As will be described later, the double-tube heat exchanger 1 includes an inside channel 4 and an outside channel 5. The inside channel 4 is arranged between the downstream end of the evaporator 93 and the upstream end of the compressor 90. The outside channel 5 is arranged between the downstream end of the condenser 91 and the upstream end of the expansion valve 92. Heat is exchanged between the low-pressure refrigerant flowing through the inside channel 4 and the high-pressure refrigerant flowing through the outside channel 5.

[Configuration of Double-Tube Heat Exchanger]

Next, the configuration of the double-tube heat exchanger of the present embodiment will be described. In the subsequent figures, the front-rear direction corresponds to the "axial direction" of the present disclosure. The rear side corresponds to "one axial end side" and "insertion direction rear side" of the present disclosure. The front side corresponds to the "the other axial end side" and "insertion direction front side" of the present disclosure.

Figure 2:
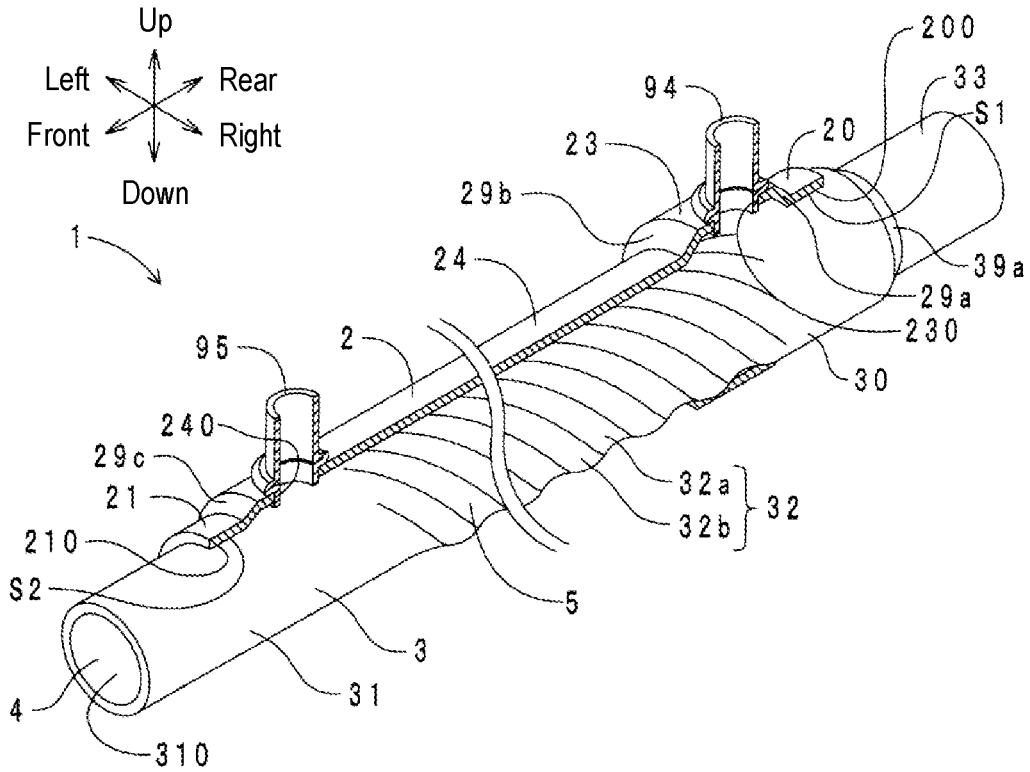
FIG. 2 is a perspective view of the double-tube heat exchanger.
Figure 3:
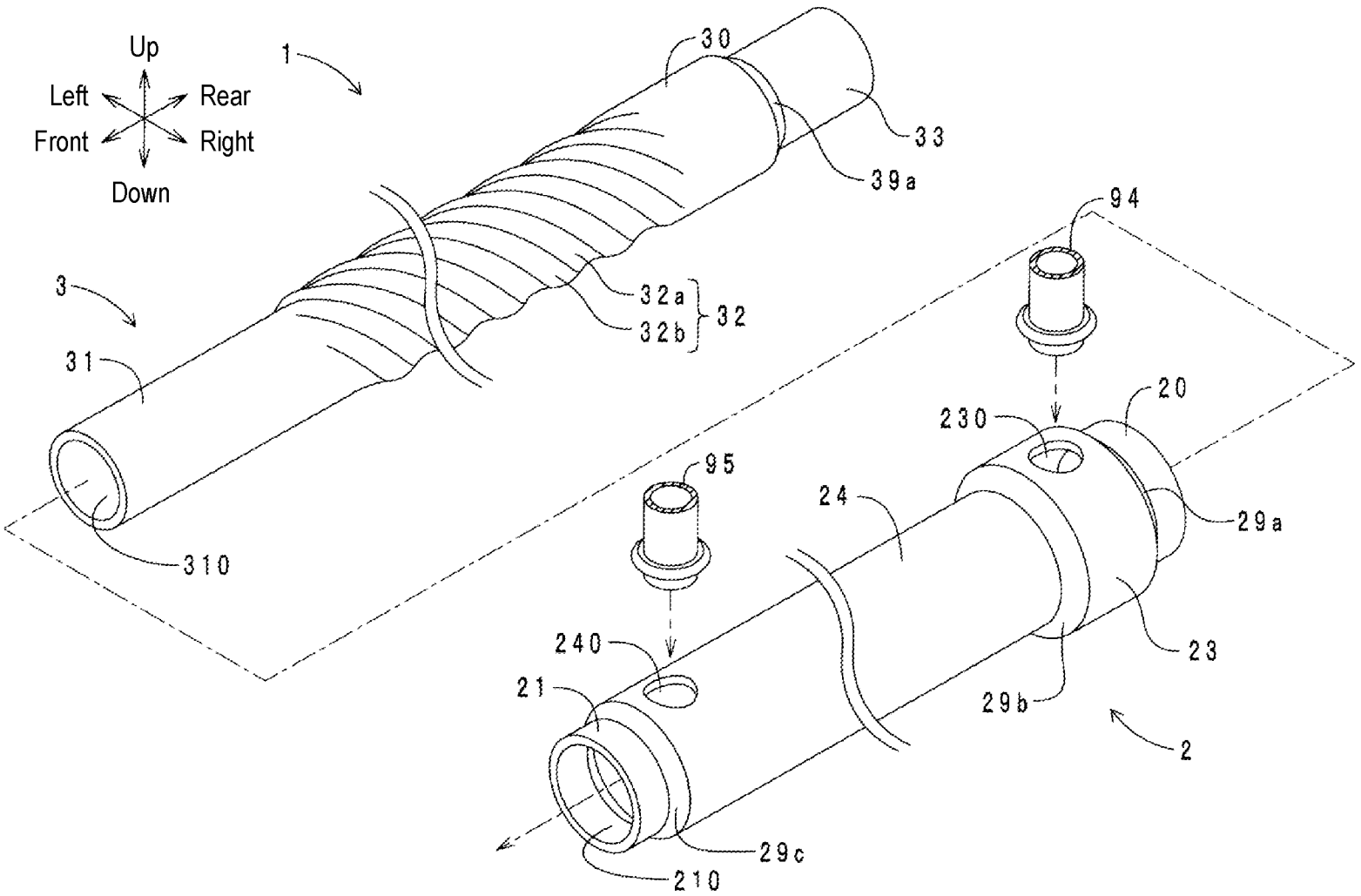
FIG. 3 is an exploded perspective view of the double-tube heat exchanger.
Figure 4:
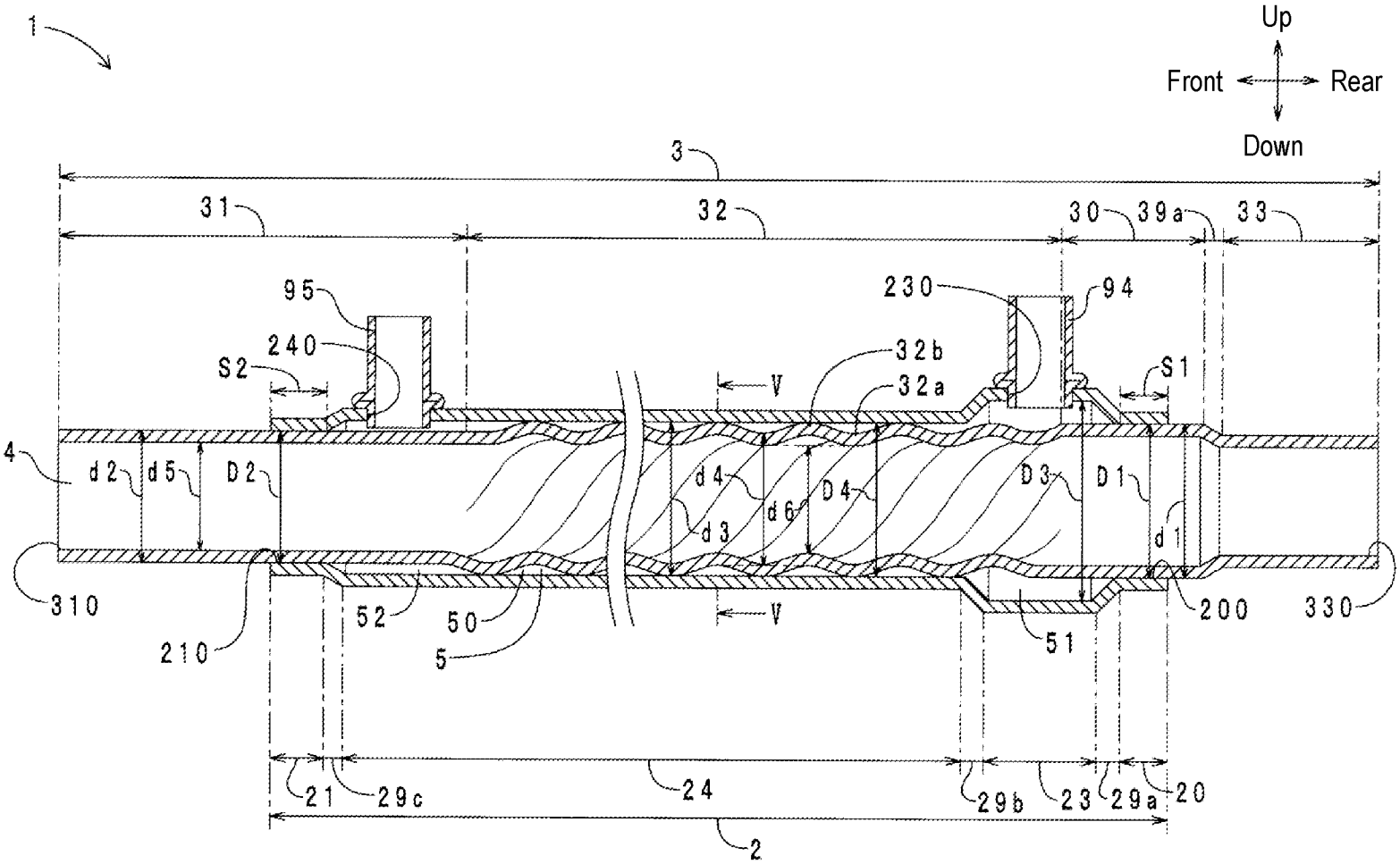
FIG. 4 is a front-rear direction cross-sectional view of the double-tube heat exchanger.
Figure 5:
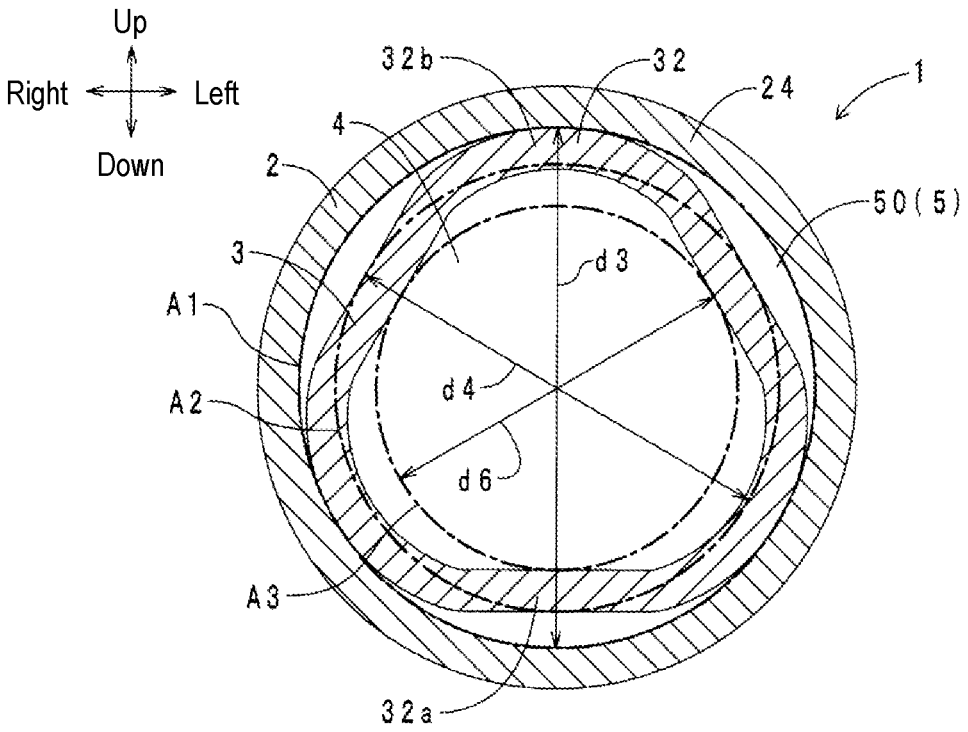
FIG. 5 is a cross-sectional view along the direction V-V of FIG. 4.

FIG. 2 shows a perspective view of the double-tube heat exchanger of the present embodiment. FIG. 3 shows an exploded perspective view of the double-tube heat exchanger. FIG. 4 shows a front-rear direction cross-sectional view of the double-tube heat exchanger. FIG. 5 shows a cross-sectional view along the direction V-V of FIG. 4. As shown in FIG. 2 to FIG. 5, the double-tube heat exchanger 1 of the present embodiment includes an outer tube 2 and an inner tube 3.

(Outer Tube)

The outer tube 2 has a circular tubular shape as a whole. The outer tube 2 is integrally formed of the same material (metal). The outer tube 2 includes an outer tube first intermediate-diameter portion (one axial end, rear end portion) 20, an outer tube small-diameter portion (the other axial end, front end portion) 21, an outer tube large-diameter portion 23, and an outer tube second intermediate-diameter portion 24.

The outer tube first intermediate-diameter portion 20 has a circular tubular shape. The outer tube first intermediate-diameter portion 20 has an opening 200. The opening 200 is at the rear end of the outer tube 2. The outer tube small-diameter portion 21 is arranged on the front side of the outer tube first intermediate-diameter portion 20. The outer tube small-diameter portion 21 has a circular tubular shape. The outer tube small-diameter portion 21 has an opening 210. The opening 210 is at the front end of the outer tube 2. The outer tube large-diameter portion 23 is connected to the front side of the outer tube first intermediate-diameter portion 20 via a tapered tube portion 29*a* that expands in diameter from the rear side to the front side. The outer tube large-diameter portion 23 has a larger inner diameter (hereinafter, "inner diameter" and "outer diameter" mean diameters unless otherwise specified) than the outer tube first intermediate-diameter portion 20. A first opening 230 is formed in the tube wall of the outer tube large-diameter portion 23. The first opening 230 is connected to a first expansion portion 51 of the outside channel 5. A first pipe 94 is inserted into the first opening 230. The first pipe 94 is connected to the upstream end of the expansion valve 92 shown in FIG. 1.

The outer tube second intermediate-diameter portion 24 is connected to the front side of the outer tube large-diameter portion 23 via a tapered tube portion 29*b* that is reduced in diameter from the rear side to the front side. Further, the outer tube second intermediate-diameter portion 24 is connected to the rear side of the outer tube small-diameter portion 21 via a tapered tube portion 29*c* that is reduced in diameter from the rear side to the front side. The outer tube second intermediate-diameter portion 24 has a circular tubular shape. The outer tube second intermediate-diameter portion 24 has the same inner diameter as the outer tube first intermediate-diameter portion 20. A second opening 240 is formed in the tube wall of the outer tube second intermediate-diameter portion 24. The second opening 240 is connected to a second expansion portion 52 of the outside channel 5. A second pipe 95 is inserted into the second opening 240. The second pipe 95 is connected to the downstream end of the condenser 91 shown in FIG. 1.

(Inner Tube)

The inner tube 3 has a circular tubular shape as a whole. The inner tube 3 is integrally formed of the same material (metal). The inner tube 3 is arranged radially inside the outer tube 2. The inner tube 3 includes an inner tube large-diameter portion 30, an inner tube first small-diameter portion 31, a spiral portion 32, and an inner tube second small-diameter portion 33.

The inner tube large-diameter portion 30 is arranged radially inside the outer tube first intermediate-diameter portion 20. The inner tube large-diameter portion 30 has a circular tubular shape. A large-diameter sealing portion S1 is arranged between the outer peripheral surface of the inner tube large-diameter portion 30 and the inner peripheral surface of the outer tube first intermediate-diameter portion 20. The large-diameter sealing portion S1 fluid-tightly seals the rear end of the outside channel 5 (so that the refrigerant does not leak from the outside channel 5 to the outside).

The inner tube first small-diameter portion 31 is arranged radially inside the outer tube small-diameter portion 21. The inner tube first small-diameter portion 31 has a circular tubular shape. A small-diameter sealing portion S2 is arranged between the outer peripheral surface of the inner tube first small-diameter portion 31 and the inner peripheral surface of the outer tube small-diameter portion 21. The small-diameter sealing portion S2 fluid-tightly seals the front end of the outside channel 5. The small-diameter sealing portion S2 has a smaller diameter than the large-diameter sealing portion S1. The small-diameter sealing portion S2 is arranged on the front side of the large-diameter sealing portion S1. The inner tube first small-diameter portion 31 has an opening 310. The opening 310 is at the front end of the inner tube 3. The opening 310 is arranged on the front side with respect to the opening 210. That is, the front end of the inner tube 3 protrudes to the front side from the front end of the outer tube 2. The opening 310 is connected to the downstream end of the inside channel 4. The opening 310 communicates with the upstream end of the compressor 90 shown in FIG. 1.

The spiral portion 32 is arranged between the inner tube large-diameter portion 30 and the inner tube first small-diameter portion 31. The spiral portion 32 is arranged by using a difference in position in the front-rear direction and a difference in diameter between the large-diameter sealing portion S1 and the small-diameter sealing portion S2. The spiral portion 32 has a spiral tubular shape. The spiral portion 32 has spiral unevenness that goes around along the tube wall of the inner tube 3. Specifically, the spiral portion 32 includes three spirally extending concave portions 32*a* and three spirally extending convex portions 32*b*. With the concave portion 32*a* as a reference, the convex portion 32*b* protrudes radially outward. On the contrary, with the convex portion 32*b* as a reference, the concave portion 32*a* is recessed radially inward.

The rear end of the spiral portion 32 is connected to the inner tube large-diameter portion 30 by the convex portion 32*b*. Thus, no tapered tube portion for adjusting a difference in diameter is interposed between the spiral portion 32 and the inner tube large-diameter portion 30. The front end of the spiral portion 32 is connected to the inner tube first small-diameter portion 31 by the concave portion 32*a*. Thus, no tapered tube portion for adjusting a difference in diameter is interposed between the spiral portion 32 and the inner tube first small-diameter portion 31. The rear end of the spiral portion 32 is arranged on the front side with respect to the rear end of the outer tube large-diameter portion 23. On the other hand, the front end of the spiral portion 32 is arranged on the rear side with respect to the rear end of the second opening 240.

The inner tube second small-diameter portion 33 is connected to the rear side of the inner tube large-diameter portion 30 via a tapered tube portion 39*a* that expands in diameter from the rear side to the front side. The inner tube second small-diameter portion 33 has a circular tubular shape. The inner tube second small-diameter portion 33 has the same outer diameter and inner diameter as the inner tube first small-diameter portion 31. The inner tube second small-diameter portion 33 has an opening 330. The opening 330 is at the rear end of the inner tube 3. The opening 330 is arranged on the rear side with respect to the opening 200. That is, the rear end of the inner tube 3 protrudes to the rear side from the rear end of the outer tube 2. The opening 330 is connected to the upstream end of the inside channel 4. The opening 330 communicates with the downstream end of the evaporator 93 shown in FIG. 1.

(Inside Channel, Outside Channel)

The inside channel 4 is formed inside the inner tube 3. The inside channel 4 is arranged between the downstream end of the evaporator 93 and the upstream end of the compressor 90. The outside channel 5 is formed between the inner tube 3 and the outer tube 2. The outside channel 5 is arranged between the downstream end of the condenser 91 and the upstream end of the expansion valve 92. The outside channel 5 includes a spiral channel portion 50, a first expansion portion 51, and a second expansion portion 52. The outside channel 5 is arranged by using a difference in position in the front-rear direction and a difference in diameter between the large-diameter sealing portion S1 and the small-diameter sealing portion S2.

The spiral channel portion 50 is arranged radially outside the spiral portion 32 and radially inside the outer tube second intermediate-diameter portion 24. The refrigerant spirally flows through the spiral channel portion 50 from the front side (upstream side) to the rear side (downstream side).

The first expansion portion 51 is arranged on the rear side of the spiral channel portion 50. The first expansion portion 51 has a larger channel cross-sectional area than the spiral channel portion 50. The first expansion portion 51 is arranged radially outside the spiral portion 32 and the inner tube large-diameter portion 30 and radially inside the outer tube large-diameter portion 23. The first expansion portion 51 is connected to the first pipe 94.

The second expansion portion 52 is arranged on the front side of the spiral channel portion 50. The second expansion portion 52 has a larger channel cross-sectional area than the spiral channel portion 50. The second expansion portion 52 is arranged radially outside the inner tube first small-diameter portion 31 and radially inside the outer tube second intermediate-diameter portion 24. That is, the rear end of the outer tube small-diameter portion 21 is arranged to be shifted to the front side with respect to the rear end of the inner tube first small-diameter portion 31. A space is defined between the inner tube first small-diameter portion 31 and the outer tube second intermediate-diameter portion 24 corresponding to the positional shift. The second expansion portion 52 corresponds to the space. The second expansion portion 52 is connected to the second pipe 95.

[Manufacturing Method for Double-Tube Heat Exchanger]

Next, a manufacturing method for the double-tube heat exchanger of the present embodiment will be described. The manufacturing method for the double-tube heat exchanger 1 includes an inner tube molding step, an outer tube molding step, an opening forming step, an inserting step, a positioning step, a sealing step, and a pipe connecting step.

(Inner Tube Molding Step)

(A) of FIG. 6 shows a front-rear direction cross-sectional view of a mold in the inner tube molding step (initial stage) of the manufacturing method for the double-tube heat exchanger of the present embodiment. (B) of FIG. 6 shows a front-rear direction cross-sectional view of the mold in the same step (final stage).

In this step, the inner tube 3 is manufactured from a tubular inner tube material 3*a* by so-called hydroforming. As shown in (A) and (B) of FIG. 6, a mold 7 includes a first mold 70, a second mold 71, a first punch 72, and a second punch 73. A substantially cylindrical cavity C1 is defined between a mold surface 700 of the first mold 70 and a mold surface 710 of the second mold 71. The mold surface 700 of the first mold 70 and the mold surface 710 of the second mold 71 are each given the shape of the outer peripheral surface of the inner tube 3 (inverted concave-convex shape). The first punch 72 is arranged at the rear end of the cavity C1. An opening 720 is formed in the first punch 72. The second punch 73 is arranged at the front end of the cavity C1. An opening 730 is formed in the second punch 73.

In this step, first, the inner tube material 3*a* is arranged in the cavity C1 of the mold 7 in a mold opened state (a state where the first mold 70 and the second mold 71 are separated). Next, the mold 7 is switched from the mold opened state to a mold closed state (a state where the first mold 70 and the second mold 71 are in contact). Subsequently, the first punch 72 seals and presses the rear end of the inner tube material 3*a*. In addition, the second punch 73 seals and presses the front end of the inner tube material 3*a*. Then, via the openings 720 and 730, high-pressure water (pressure medium) is injected from the outside into the inner tube material 3*a*. Due to water pressure, the inner tube material 3*a* (in detail, the portions of the inner tube material 3*a* corresponding to the convex portion 32*b* of the spiral portion 32, the inner tube large-diameter portion 30, and the tapered tube portion 39*a* of the inner tube 3 shown in FIG. 4) is expanded and deformed. Due to the deformation, the shapes of the mold surfaces 700 and 710 are transferred to the outer peripheral surface of the inner tube material 3*a*. Thus, the inner tube 3 is molded.

(Outer Tube Molding Step, Opening Forming Step)

(A) of FIG. 7 shows a front-rear direction cross-sectional view of the mold in the outer tube molding step (initial stage) of the manufacturing method for the double-tube heat exchanger of the present embodiment. (B) of FIG. 7 shows a front-rear direction cross-sectional view of the mold in the same step (final stage).

In the outer tube molding step, the outer tube 2 is manufactured from a tubular outer tube material 2*a* by so-called hydroforming. As shown in (A) and (B) of FIG. 7, the configuration of a mold 8 is the same as the configuration of the mold 7. That is, the mold 8 includes a first mold 80, a second mold 81, a first punch 82, and a second punch 83. A substantially cylindrical cavity C2 is defined between a mold surface 800 and a mold surface 810. The mold surfaces 800 and 810 are each given the shape of the outer peripheral surface of the outer tube 2 (inverted concave-convex shape).

As in the inner tube molding step described above, in the outer tube molding step, first, the outer tube material 2*a* is arranged in the cavity C2 of the mold 8 in a mold opened state (a state where the first mold 80 and the second mold 81 are separated). Next, the mold 8 is switched from the mold opened state to a mold closed state (a state where the first mold 80 and the second mold 81 are in contact). Subsequently, the first punch 82 and the second punch 83 seal and press both the front and rear ends of the outer tube material 2*a*. Then, via the openings 820 and 830, high-pressure water (pressure medium) is injected from the outside into the outer tube material 2*a*. Due to water pressure, the outer tube material 2*a* (in detail, the portions (the outer tube first intermediate-diameter portion 20, the outer tube large-diameter portion 23, the outer tube second intermediate-diameter portion 24, and the tapered tube portions 29*a* to 29*c*) of the outer tube material 2*a* other than the outer tube small-diameter portion 21 of the outer tube 2 shown in FIG. 4) is expanded and deformed. Due to the deformation, the shapes of the mold surfaces 800 and 810 are transferred to the outer peripheral surface of the outer tube material 2*a*. Thus, the outer tube 2 is molded.

In the opening forming step, the first opening 230 shown in FIG. 4 is formed in the outer tube large-diameter portion 23 shown in (B) of FIG. 7. Also, the second opening 240 shown in FIG. 4 is formed in the outer tube second intermediate-diameter portion 24.

(Inserting Step, Positioning Step, Joining Step, Pipe Joining Step)

(A) of FIG. 8 shows a front-rear direction cross-sectional view of the inner tube and the outer tube in the inserting step (initial stage) of the manufacturing method for the double-tube heat exchanger of the present embodiment. (B) of FIG. 8 shows a front-rear direction cross-sectional view of the inner tube and the outer tube in the same step (final stage) and the positioning step (initial stage). (A) of FIG. 9 shows a front-rear direction cross-sectional view of the inner tube and the outer tube in the positioning step (final stage) and the sealing step of the manufacturing method. (B) of FIG. 9 shows a front-rear direction cross-sectional view of the inner tube and the outer tube in the pipe connecting step of the manufacturing method.

As shown in (A) and (B) of FIG. 8, in the inserting step, the front end (inner tube first small-diameter portion 31) of the inner tube 3 is inserted into the rear end (outer tube first intermediate-diameter portion 20) of the outer tube 2. As shown in (A) of FIG. 9, in the positioning step, the inner tube 3 is moved forward relative to the outer tube 2. Then, the inner tube large-diameter portion 30 is positioned radially inside the outer tube first intermediate-diameter portion 20. Also, the inner tube first small-diameter portion 31 is positioned radially inside the outer tube small-diameter portion 21. In the sealing step, the outer tube first intermediate-diameter portion 20 and the inner tube large-diameter portion 30 after positioning are connected. Also, the outer tube small-diameter portion 21 and the inner tube first small-diameter portion 31 after positioning are connected. That is, the outside channel 5 is fluid-tightly sealed. As shown in (B) of FIG. 9, in the pipe connecting step, the first pipe 94 is connected to the first opening 230. Also, the second pipe 95 is connected to the second opening 240. Thereafter, at least a part of the double-tube heat exchanger 1 is curved appropriately according to the path of the heat pump cycle 9 shown in FIG. 1.

[Movement of Double-Tube Heat Exchanger]

Next, the movement of the double-tube heat exchanger of the present embodiment will be described. As shown in FIG. 1, the inside channel 4 is arranged between the downstream end of the evaporator 93 and the upstream end of the compressor 90. The outside channel 5 is arranged between the downstream end of the condenser 91 and the upstream end of the expansion valve 92. As shown in FIG. 4, heat is exchanged between the low-pressure refrigerant flowing through the inside channel 4 and the high-pressure refrigerant flowing through the outside channel 5 via the tube wall of the inner tube 3. That is, the spiral portion 32 is arranged on the inner tube 3. Spiral unevenness is formed on the outer peripheral surface and the inner peripheral surface of the spiral portion 32. The refrigerant in the inside channel 4 and the refrigerant in the outside channel 5 flow along the unevenness. That is, the refrigerant in the inside channel 4 and the refrigerant in the outside channel 5 flow in opposite directions via the spiral portion 32. At this time, heat is exchanged between the refrigerant in the inside channel 4 and the refrigerant in the outside channel 5. Specifically, heat is transferred from the refrigerant in the outside channel 5 to the refrigerant in the inside channel 4 via the spiral portion 32. The refrigerant in the outside channel 5 is cooled and the refrigerant in the inside channel 4 is heated.

[Effect]

Next, the effects of the double-tube heat exchanger and the manufacturing method therefor of the present embodiment will be described. In the double-tube heat exchanger 1 of the present embodiment, a space resulting from a difference in axial position between the large-diameter sealing portion S1 and the small-diameter sealing portion S2 and a difference in diameter between the large-diameter sealing portion S1 and the small-diameter sealing portion S2 is secured. With the double-tube heat exchanger 1 of the present embodiment, it is possible to arrange at least a part of the outside channel 5 and at least a part of the spiral portion 32 by using the space. Thus, the structure of the double-tube heat exchanger 1 is simplified.

In addition, with the manufacturing method for the double-tube heat exchanger 1 of the present embodiment, it is possible to easily insert the front end of the inner tube 3 into the rear end of the outer tube by using a difference in diameter between the large-diameter sealing portion S1 and the small-diameter sealing portion S2. Thus, it is possible to improve the assemblability between the inner tube 3 and the outer tube 2.

As shown in FIG. 4, according to the double-tube heat exchanger 1 and the manufacturing method therefor of the present embodiment, the following formulas (1) and (2) are established.

$$D1>D2 \quad (1)$$

$$d1\geq d3>d2 \quad (2)$$

D1: inner diameter of outer tube first intermediate-diameter portion 20

D2: inner diameter of outer tube small-diameter portion 21 d1: outer diameter of inner tube large-diameter portion 30 d2: outer diameter of inner tube first small-diameter portion 31 d3: maximum outer diameter of spiral portion 32 (as shown in FIG. 5, the maximum outer diameter d3 is the diameter of a virtual circle A1 that connects the radial outer ends of the outer peripheral surfaces of the convex portions 32*b* of the spiral portion 32 in the circumferential direction)

That is, the inner diameter D1 of the outer tube first intermediate-diameter portion 20 is larger than the inner diameter D2 of the outer tube small-diameter portion 21. In addition, the outer diameter d1 of the inner tube large-diameter portion 30 is equal to or larger than the maximum outer diameter d3 of the spiral portion 32. Also, the maximum outer diameter d3 of the spiral portion 32 is larger than the outer diameter d2 of the inner tube first small-diameter portion 31.

Since the formulas (1) and (2) are established, as shown in (A) of FIG. 8, in the inserting step, it is easy to determine the insertion direction of the inner tube 3 into the outer tube 2 when inserting the inner tube 3 into the outer tube 2.

Moreover, since the formula (2) is established, as shown in (A) of FIG. 9, it is possible to arrange the outer tube first intermediate-diameter portion 20 and the inner tube large-diameter portion 30 close to each other after positioning the inner tube 3 and the outer tube 2 in the positioning step, compared to the case where the outer diameter d1 of the inner tube large-diameter portion 30 is the same as the outer diameter d2 of the inner tube first small-diameter portion 31. Thus, in the sealing step, the work of connecting the outer tube first intermediate-diameter portion 20 and the inner tube large-diameter portion 30 can be easily performed.

As shown in FIG. 4, according to the double-tube heat exchanger 1 and the manufacturing method therefor of the present embodiment, the following formula (3) is established.

$$D1>d2 \quad (3).$$

That is, the inner diameter D1 of the outer tube first intermediate-diameter portion 20 having the rear end (opening 200) of the outer tube 2 is larger than the outer diameter d2 of the inner tube first small-diameter portion 31 having the front end (opening 310) of the inner tube 3. Specifically, the inner diameter D1 of the outer tube first intermediate-diameter portion 20 is larger than the outer diameter d2 of the inner tube first small-diameter portion 31 by the diameter difference between the maximum outer diameter d3 of the spiral portion 32 and the minimum outer diameter d4 described later. Thus, as shown in (A) of FIG. 8, it is possible to prevent the front end of the inner tube 3 from interfering with the rear end of the outer tube 2 when inserting the inner tube 3 into the outer tube 2 in the inserting step.

As shown in FIG. 4, according to the double-tube heat exchanger 1 and the manufacturing method therefor of the present embodiment, the following formula (4) is established.

$$D3>D1=D4 \quad (4)$$

D3: inner diameter of outer tube large-diameter portion 23

D4: inner diameter of outer tube second intermediate-diameter portion 24

That is, the inner diameter D3 of the outer tube large-diameter portion 23 is larger than the inner diameter D1 of the outer tube first intermediate-diameter portion 20. In addition, the inner diameter D1 of the outer tube first intermediate-diameter portion 20 is the same as the inner diameter of the outer tube second intermediate-diameter portion 24. Thus, as shown in (A) of FIG. 8, it is possible to prevent the inner tube 3 from interfering with the outer tube large-diameter portion 23 (first opening 230) when inserting the inner tube 3 into the outer tube 2 in the inserting step.

As shown in FIG. 4, according to the double-tube heat exchanger 1 and the manufacturing method therefor of the present embodiment, the following formulas (5) and (6) are established.

$$d2=d4 \quad (5)$$

$$d1=d3 \quad (6)$$

d4: minimum outer diameter of spiral portion 32 (as shown in FIG. 5, the minimum outer diameter d4 is the diameter of a virtual circle A2 that connects the radial inner ends of the outer peripheral surfaces of the concave portions 32*a* in the circumferential direction)

That is, the inner tube first small-diameter portion 31 having the same diameter as the concave portion 32*a* is connected to the front end of the spiral portion 32. Further, the inner tube large-diameter portion 30 having the same diameter as the convex portion 32*b* is connected to the rear end of the spiral portion 32. Thus, even though there is a difference in diameter (d1>d2) between the inner tube first small-diameter portion 31 (outer diameter d2) and the inner tube large-diameter portion 30 (outer diameter d1), it is not required to arrange a tapered tube portion or the like for adjusting the difference in diameter. Thus, it is possible to increase the length of the spiral portion 32 in the front-rear direction. That is, the heat transfer area can be increased.

As shown in FIG. 4, according to the double-tube heat exchanger 1 and the manufacturing method therefor of the present embodiment, the following formulas (7) and (8) are established.

$$D1>d1 \quad (7)$$

$$D2>d2 \quad (8)$$

In formula (7), the difference in diameter between the inner diameter D1 of the outer tube first intermediate-diameter portion 20 and the outer diameter d1 of the inner tube large-diameter portion 30 is small. Thus, as shown in (A) of FIG. 9, it is possible to easily perform the work of connecting (welding, brazing, bonding, crimping, etc.) the outer tube first intermediate-diameter portion 20 and the inner tube large-diameter portion 30 in the sealing step.

Similarly, in formula (8), the difference in diameter between the inner diameter D2 of the outer tube small-diameter portion 21 and the outer diameter d2 of the inner tube first small-diameter portion 31 is small. Thus, as shown in (A) of FIG. 9, it is possible to easily perform the work of connecting (welding, brazing, bonding, crimping, etc.) the outer tube small-diameter portion 21 and the inner tube first small-diameter portion 31 in the sealing step.

As shown in FIG. 4, according to the double-tube heat exchanger 1 and the manufacturing method therefor of the present embodiment, the following formula (9) is established.

$$d3>D2 \quad (9)$$

That is, the maximum outer diameter d3 of the spiral portion 32 is larger than the inner diameter D2 of the outer tube small-diameter portion 21. Thus, as shown in (A) of FIG. 9, there is no risk that the spiral portion 32 may drop forward from the outer tube small-diameter portion 21 in the positioning step. Thus, the positioning of the inner tube 3 with respect to the outer tube 2 is easy.

As shown in FIG. 4, according to the double-tube heat exchanger 1 and the manufacturing method therefor of the present embodiment, the following formula (10) is established.

$$d5\leq d6 \quad (10)$$

d5: inner diameter of inner tube first small-diameter portion 31 d6: minimum inner diameter of spiral portion 32 (as shown in FIG. 5, the minimum inner diameter d6 is the diameter of a virtual circle A3 that connects the radial inner ends of the inner peripheral surfaces of the concave portions 32*a* in the circumferential direction)

That is, the inner diameter d5 of the inner tube first small-diameter portion 31 (the inner diameter of the inner tube second small-diameter portion 33 is the same) is equal to or smaller than the minimum inner diameter d6 of the spiral portion 32. Thus, it is possible to prevent the spiral portion 32 from protruding radially inside the inner tube first small-diameter portion 31 and the inner tube second small-diameter portion 33. Thus, it is possible to reduce the channel resistance of the inside channel 4.

As shown in FIG. 2 to FIG. 4, the inner tube 3 includes the spiral portion 32. Spiral unevenness is formed on the outer peripheral surface of the spiral portion 32. Thus, it is possible to increase the heat transfer area of the outer peripheral surface of the spiral portion 32, compared to the case where the inner tube 3 does not include the spiral portion 32. In addition, the refrigerant is able to flow spirally in the outside channel 5. Thus, it is possible to lengthen the time of contact between the refrigerant and the outer peripheral surface of the spiral portion 32. Similarly, spiral unevenness is formed on the inner peripheral surface of the spiral portion 32. Thus, it is possible to increase the heat transfer area of the inner peripheral surface of the spiral portion 32, compared to the case where the inner tube 3 does not include the spiral portion 32. In addition, the refrigerant (at least a part of the refrigerant) is able to flow spirally in the inside channel 4. Thus, it is possible to lengthen the time of contact between the refrigerant and the inner peripheral surface of the spiral portion 32.

As shown in FIG. 4, the rear end of the outer tube small-diameter portion 21 is shifted forward with respect to the rear end of the inner tube first small-diameter portion 31. Thus, it is possible to secure the second expansion portion 52 between the inner tube first small-diameter portion 31 and the outer tube small-diameter portion 21. That is, it is possible to secure the second expansion portion 52 by using the positional shift between the rear end of the inner tube first small-diameter portion 31 and the rear end of the outer tube small-diameter portion 21 and the difference in diameter between the inner tube first small-diameter portion 31 and the outer tube small-diameter portion 21 without intentionally forming an enlarged diameter portion in the outer tube 2 or forming a reduced diameter portion in the inner tube 3 (however, the present disclosure does not exclude these aspects).

As shown in FIG. 4, the first expansion portion 51 has a larger channel cross-sectional area than the spiral channel portion 50. Thus, it is possible to stably merge the refrigerant flowing from the spiral channel portion 50 into the first expansion portion 51 to reduce the pressure loss. Similarly, the second expansion portion 52 has a larger channel cross-sectional area than the second opening 240 (second pipe 95). Thus, it is possible to stably diffuse the refrigerant flowing from the second pipe 95 into the second expansion portion 52 to reduce the pressure loss.

As shown in FIG. 4, (A) of FIG. 7, and (B) of FIG. 7, the outer tube large-diameter portion 23 (first expansion portion 51) and the outer tube second intermediate-diameter portion 24 (second expansion portion 52) are formed by expanding and deforming the outer tube material 2*a* in the outer tube molding step. Thus, it is possible to manufacture the inner tube 3 simply by the inner tube molding step (hydroforming) shown in (A) and (B) of FIG. 6, compared to the case where the first expansion portion 51 and the second expansion portion 52 are formed by reducing the inner tube 3 in diameter and deforming the inner tube 3 (however, the present disclosure does not exclude this aspect).

As shown in FIG. 4, the rear end of the spiral portion 32 is arranged on the front side with respect to the rear end of the outer tube large-diameter portion 23. Thus, it is possible to prevent the spiral portion 32 from entering the outer tube first intermediate-diameter portion 20. Thus, it is possible to suppress deterioration of the sealing performance of the large-diameter sealing portion S1.

As shown in FIG. 4, the front end of the spiral portion 32 is arranged on the rear side with respect to the rear end of the second opening 240. Thus, it is possible to secure the second expansion portion 52 with a large volume below the second opening 240, compared to the case where the front end of the spiral portion 32 is arranged on the front side with respect to the rear end of the second opening 240 (however, the present disclosure does not exclude this aspect).

As shown in FIG. 4, the second pipe 95 opening to the outside channel 5 is inserted into the second opening 240. In addition, the lower end (insertion end) of the second pipe 95 protrudes downward (radially inward) from the inner peripheral surface of the outer tube second intermediate-diameter portion 24. Here, the front end of the spiral portion 32 is arranged on the rear side with respect to the rear end of the second opening 240. Thus, it is possible to prevent the spiral portion 32 from interfering with the lower end of the second pipe 95.

The outer tube 2 is made of metal and is integrally formed. Thus, it is easy to ensure the sealing performance of the outside channel 5, compared to the case where the outer tube 2 is not integrally formed (the case where the outer tube 2 has a joint). Similarly, the inner tube 3 is made of metal and is integrally formed. Thus, it is easy to ensure the sealing performance of the inside channel 4 and the outside channel 5, compared to the case where the inner tube 3 is not integrally formed (the case where the inner tube 3 has a joint).

As shown in (B) of FIG. 9, the pipe connecting step is performed after the sealing step. Thus, handling of the outer tube 2 is improved in the inserting step shown in (A) and (B) of FIG. 8, the positioning step shown in (A) of FIG. 9, and the sealing step.

Second Embodiment

A difference between the double-tube heat exchanger and the manufacturing method therefor of the present embodiment and the double-tube heat exchanger and the manufacturing method therefor of the first embodiment is that the outer tube includes two outer tube large-diameter portions. Here, the description will focus on the difference. FIG. 10 shows a front-rear direction cross-sectional view of the double-tube heat exchanger of the present embodiment. Parts corresponding to those in FIG. 4 are denoted by the same reference numerals.

As shown in FIG. 10, the outer tube 2 includes an outer tube first large-diameter portion 23*a* (corresponding to the outer tube large-diameter portion 23 of FIG. 4) and an outer tube second large-diameter portion 23*b*. The outer tube second large-diameter portion 23*b* is arranged between the outer tube second intermediate-diameter portion 24 and the outer tube small-diameter portion 21. The rear end of the spiral portion 32 is arranged at the center of the outer tube first large-diameter portion 23*a* in the front-rear direction. Also, the front end of the spiral portion 32 is arranged at the center of the outer tube second large-diameter portion 23*b* in the front-rear direction.

The double-tube heat exchanger and the manufacturing method therefor of the present embodiment achieve the same effects as the double-tube heat exchanger and the manufacturing method therefor of the first embodiment with respect to the parts having the common configurations. As in the double-tube heat exchanger 1 of the present embodiment, a second expansion portion 52 having a volume equivalent to the volume of the first expansion portion 51 may be arranged.

When the rear end of the spiral portion 32 enters the outer tube first intermediate-diameter portion 20, there is a risk that the sealing performance of the large-diameter sealing portion S1 may deteriorate. On the other hand, when the rear end of the spiral portion 32 enters the outer tube second intermediate-diameter portion 24, the length of the spiral channel portion 50 in the front-rear direction is shortened. Thus, the heat transfer area is reduced. In this regard, the rear end of the spiral portion 32 is arranged at the center of the outer tube first large-diameter portion 23*a* in the front-rear direction. Thus, it is possible to suppress deterioration of the sealing performance of the large-diameter sealing portion S1. Also, it is possible to prevent the length of the spiral channel portion 50 in the front-rear direction from being shortened.

In the positioning step shown in (A) of FIG. 9, "the position where the rear end of the spiral portion 32 is at the center of the outer tube first large-diameter portion 23*a* in the front-rear direction" may be the target position of the inner tube 3 with respect to the outer tube 2. In this way, even if the actual position is slightly shifted from the target position, it is still possible to suppress deterioration of the sealing performance of the large-diameter sealing portion S1. Also, it is possible to prevent the length of the spiral channel portion 50 in the front-rear direction from being shortened.

Similarly, when the front end of the spiral portion 32 enters the outer tube small-diameter portion 21, there is a risk that the sealing performance of the small-diameter sealing portion S2 may deteriorate. On the other hand, when the front end of the spiral portion 32 enters the outer tube second intermediate-diameter portion 24, the length of the spiral channel portion 50 in the front-rear direction is shortened. Thus, the heat transfer area is reduced. In this regard, the front end of the spiral portion 32 is arranged at the center of the outer tube second large-diameter portion 23*b* in the front-rear direction. Thus, it is possible to suppress deterioration of the sealing performance of the small-diameter sealing portion S2. Also, it is possible to prevent the length of the spiral channel portion 50 in the front-rear direction from being shortened.

In the positioning step shown in (A) of FIG. 9, "the position where the front end of the spiral portion 32 is at the center of the outer tube second large-diameter portion 23*b* in the front-rear direction" may be the target position of the inner tube 3 with respect to the outer tube 2. In this way, even if the actual position is slightly shifted from the target position, it is still possible to suppress deterioration of the sealing performance of the small-diameter sealing portion S2. Also, it is possible to prevent the length of the spiral channel portion 50 in the front-rear direction from being shortened.

Third Embodiment

A difference between the double-tube heat exchanger and the manufacturing method therefor of the present embodiment and the double-tube heat exchanger and the manufacturing method therefor of the first embodiment is that the double-tube heat exchanger does not include the first expansion portion and the second expansion portion. Another difference is that the inner tube includes a positioning portion. Here, the description will focus on the differences. FIG. 11 shows a front-rear direction cross-sectional view of the double-tube heat exchanger of the present embodiment. Parts corresponding to those in FIG. 4 are denoted by the same reference numerals.

As shown in FIG. 11, the inner tube 3 includes the inner tube first small-diameter portion 31, the spiral portion 32, the inner tube large-diameter portion 30, the positioning portion 34, the tapered tube portion 39*a*, and the inner tube second small-diameter portion 33, from the front side to the rear side. The outer tube 2 includes the outer tube small-diameter portion 21, the tapered tube portion 29*d*, and the outer tube intermediate-diameter portion 20*a*, from the front side to the rear side.

A first opening 200*a* and a second opening 201*a* are formed in the tube wall of the outer tube intermediate-diameter portion 20*a*. The first pipe 94 is connected to the first opening 200*a*. The first expansion portion 51 (see FIG. 4) is not arranged below (radially inside) the first opening 200*a*. The spiral channel portion 50 (spiral portion 32) is arranged below the first opening 200*a*. The second pipe 95 is connected to the second opening 201*a*. The second expansion portion 52 (see FIG. 4) is not arranged below (radially inside) the second opening 201*a*. The spiral channel portion 50 (spiral portion 32) is arranged below the second opening 201*a*.

The positioning portion 34 protrudes radially outward from the rear end of the inner tube large-diameter portion 30. In the positioning step shown in (A) of FIG. 9, the inner tube 3 and the outer tube 2 are positioned so that the positioning portion 34 contacts the rear end of the outer tube 2.

The double-tube heat exchanger and the manufacturing method therefor of the present embodiment achieve the same effects as the double-tube heat exchanger and the manufacturing method therefor of the first embodiment with respect to the parts having the common configurations. The double-tube heat exchanger 1 of the present embodiment does not include the first expansion portion 51 and the second expansion portion 52 (see FIG. 4). Thus, the structure of the outer tube 2 is simplified. Accordingly, the productivity of the outer tube 2 and thus the double-tube heat exchanger 1 is improved. The double-tube heat exchanger 1 of the present embodiment includes the positioning portion 34. Thus, in the positioning step shown in (A) of FIG. 9, it is possible to easily position the inner tube 3 and the outer tube 2.

Fourth Embodiment

A difference between the double-tube heat exchanger and the manufacturing method therefor of the present embodiment and the double-tube heat exchanger and the manufacturing method therefor of the first embodiment is that the inner tube includes an uneven portion with heat transfer fins. Here, the description will focus on the difference. (A) of FIG. 12 shows a front-rear direction cross-sectional view of the double-tube heat exchanger of the present embodiment. Parts corresponding to those in FIG. 4 are denoted by the same reference numerals. (B) of FIG. 12 shows a cross-sectional view along the direction XIIB-XIIB of (A) of FIG. 12. Parts corresponding to those in FIG. 5 are denoted by the same reference numerals.

As shown in (A) and (B) of FIG. 12, the inner tube 3 includes the inner tube first small-diameter portion 31, the uneven portion 35, the tapered tube portion 39*b*, the inner tube large-diameter portion 30, the tapered tube portion 39*a*, and the inner tube second small-diameter portion 33, from the front side to the rear side. The uneven portion 35 includes a base tube portion 35*a* and a plurality of heat transfer fins 35*b*. The base tube portion 35*a* has the same inner diameter and outer diameter as the inner tube first small-diameter portion 31. The heat transfer fins 35*b* protrude from the outer peripheral surface of the base tube portion 35*a*. The heat transfer fins 35*b* are shaped like thin plates extending in the front-rear direction. The plurality of heat transfer fins 35*b* are spaced apart from each other by a predetermined angle in the circumferential direction. A straight channel portion 53 extending in the front-rear direction is formed between a pair of adjacent heat transfer fins 35*b*.

The double-tube heat exchanger and the manufacturing method therefor of the present embodiment achieve the same effects as the double-tube heat exchanger and the manufacturing method therefor of the first embodiment with respect to the parts having the common configurations. The inner tube 3 includes the uneven portion 35. The uneven portion 35 includes the plurality of heat transfer fins 35*b*. Thus, it is possible to increase the heat transfer area, compared to the case where there is no heat transfer fin 35*b*.

<Others>

The embodiments of the double-tube heat exchanger and the manufacturing method therefor according to the present disclosure have been described above. However, the embodiments are not particularly limited to the above forms. It is also possible to implement the present disclosure in various modified forms and improved forms that can be made by those skilled in the art.

(A) of FIG. 13 shows a radial direction cross-sectional view of the double-tube heat exchanger of another embodiment (No. 1). (B) of FIG. 13 shows a radial direction cross-sectional view of the double-tube heat exchanger of another embodiment (No. 2). Parts corresponding to those in FIG. 5 are denoted by the same reference numerals.

As shown in (A) of FIG. 13, there may be a gap E between the outer tube second intermediate-diameter portion 24 and the convex portion 32*b* of the spiral portion 32. Of course, as shown in FIG. 5 described above, there may be no gap between the outer tube second intermediate-diameter portion 24 and the convex portion 32*b* of the spiral portion 32. As shown in (B) of FIG. 13, the spiral portion 32 may include four spirally extending concave portions 32*a* and four spirally extending convex portions 32*b*. That is, the number of concave portions 32*a* and convex portions 32*b* arranged (the number of lines) is not particularly limited. Moreover, the pitch of the convex portion 32*b* in the front-rear direction is not particularly limited, and may or may not be constant.

The shape, extending direction, position, number, material, etc. of the heat transfer fins 35*b* of the uneven portion 35 shown in (A) and (B) of FIG. 12 are not particularly limited. Similar to the gap E shown in (A) of FIG. 13, there may be a gap between the outer tube second intermediate-diameter portion 24 and the radial outer end of the heat transfer fin 35*b*. Further, a plurality of heat transfer fins 35*b* may be arranged in a row at predetermined intervals in the axial direction. In addition, the heat transfer fins 35*b* may extend spirally like the convex portions 32*b* shown in FIG. 2. Besides, the base tube portion 35*a* and the heat transfer fins 35*b* may be made of the same material, or may be made of different materials. Furthermore, the base tube portion 35*a* and the heat transfer fins 35*b* may or may not be integrally formed.

The configurations of the double-tube heat exchangers 1 of the above embodiments may be combined as appropriate. For example, the rear end of the spiral portion 32 of the double-tube heat exchanger 1 shown in FIG. 4 may be arranged at the center of the outer tube large-diameter portion 23 in the front-rear direction, as in the double-tube heat exchanger 1 shown in FIG. 10. In addition, the positioning portion 34 shown in FIG. 11 may be arranged in the inner tube 3 of the double-tube heat exchanger 1 shown in FIG. 4.

It is not necessary to arrange the entire outside channel 5 by using the difference in axial position and the difference in diameter between the large-diameter sealing portion S1 and the small-diameter sealing portion S2. At least a part of the outside channel 5 (for example, at least one of the spiral channel portion 50, the first expansion portion 51, and the second expansion portion 52) may be arranged by using the difference in axial position and the difference in diameter between the large-diameter sealing portion S1 and the small-diameter sealing portion S2. Similarly, it is not necessary to arrange the entire spiral portion 32 by using the difference in axial position and the difference in diameter between the large-diameter sealing portion S1 and the small-diameter sealing portion S2. At least a part of the spiral portion 32 may be arranged by using the difference in axial position and the difference in diameter between the large-diameter sealing portion S1 and the small-diameter sealing portion S2.

As shown in FIG. 4 and FIG. 10, the volumes of the first expansion portion 51 and the second expansion portion 52 are not particularly limited. The volumes may be the same or different. In addition, as shown in FIG. 11, the first expansion portion 51 and the second expansion portion 52 may not be arranged.

The form of the uneven portion (the spiral portion 32 shown in FIG. 4, (A) of FIG. 13, and (B) of FIG. 13, the uneven portion 35 shown in (A) and (B) of FIG. 12, etc.) is not particularly limited. The outer peripheral surface of the base tube portion 35*a* shown in (A) and (B) of FIG. 12 may be provided with an uneven shape such as a striped pattern, a dapple pattern, and a polka dot pattern. The position of the uneven portion is not particularly limited. The uneven portion may be arranged in at least a part of the front-rear section between the front end of the first opening 230 and the rear end of the second opening 240 shown in FIG. 4. In addition, the uneven portion may be arranged in the outer tube 2. That is, the inner peripheral surface of the outer tube 2 may be provided with an uneven shape. Furthermore, uneven portions may be arranged in the outer tube 2 and the inner tube 3.

The materials of the outer tube 2 and the inner tube 3 are not particularly limited. Aluminum, aluminum alloys, copper, stainless steel, titanium, etc. may be used. The outer tube 2 and the inner tube 3 may be made of the same material or may be made of different materials. Each of the outer tube 2 and the inner tube 3 may be integrally formed, or may be a joint body of a plurality of tubular bodies. The shapes of the outer tube 2 and the inner tube 3 are not particularly limited. The shapes may be circularly tubular (perfect circularly tubular, elliptically tubular) or angularly tubular (triangularly tubular, rectangularly tubular, or the like). The double-tube heat exchanger 1 may have a straight tube shape, a curved tube shape, or the like. When the double-tube heat exchanger 1 has a straight tube shape, the axial direction of the double-tube heat exchanger 1 may be oriented in the horizontal direction, the vertical direction, or a direction inclined with respect to the vertical direction and the horizontal direction. Further, the double-tube heat exchanger 1 may have a shape obtained by appropriately combining a straight tube and a curved tube. That is, the double-tube heat exchanger 1 may have at least one curved portion. In this case, the axial direction of the double-tube heat exchanger 1 may be curved according to the extending shape of the double-tube heat exchanger 1.

The difference in diameter between the inner diameter D1 of the outer tube first intermediate-diameter portion 20 and the outer diameter d2 of the inner tube first small-diameter portion 31 shown in FIG. 4 is not particularly limited. As shown in (A) and (B) of FIG. 8, the larger the difference in diameter, the easier the inserting step may be performed. Preferably, the following formula (11) is established.

$$0.1<\{(D1-d2)/D1\}\times 100<5 \quad (11)$$

In the manufacturing method for the double-tube heat exchanger 1, the order of the inner tube molding step shown in (A) and (B) of FIG. 6 and the outer tube molding step shown in (A) and (B) of FIG. 7 is not particularly limited. The outer tube molding step may be performed prior to the inner tube molding step. In addition, other steps (one or more) may be performed between the two steps.

The opening forming step may be performed after the outer tube molding step and before the pipe connecting step. For example, the opening forming step may be performed between the inserting step shown in (A) and (B) of FIG. 8 and the positioning step shown in (A) of FIG. 9. Further, the opening forming step may be performed between the positioning step and the sealing step shown in (A) of FIG. 9. Further, the opening forming step may be performed between the sealing step shown in (A) of FIG. 9 and the pipe connecting step shown in (B) of FIG. 9.

The pipe connecting step shown in (B) of FIG. 9 may be performed before the inserting step shown in (A) and (B) of FIG. 8. In this case, as shown in FIG. 4, the lower end (insertion end) of the first pipe 94 protrudes downward (radially inward) from the inner peripheral surface of the outer tube large-diameter portion 23. However, the lower end of the first pipe 94 is arranged above (radially outside) the inner peripheral surface of the outer tube first intermediate-diameter portion 20. Thus, it is possible to prevent the front end of the inner tube 3 from interfering with the lower end of the first pipe 94 in the inserting step and the positioning step. Similarly, the lower end (insertion end) of the second pipe 95 protrudes radially inward from the inner peripheral surface of the outer tube second intermediate-diameter portion 24. However, the lower end of the second pipe 95 is arranged radially outside the inner peripheral surface of the outer tube first intermediate-diameter portion 20. Thus, it is possible to prevent the front end of the inner tube 3 from interfering with the lower end of the second pipe 95 in the inserting step and the positioning step.

The manufacturing method for the outer tube 2 and the inner tube 3 is not limited to hydroforming. The outer tube 2 and the inner tube 3 may be manufactured by other methods. For example, the spiral portion 32 may be formed in the inner tube 3 by recessing spiral grooves (concave portions 32*a*) in the outer peripheral surface of the inner tube material 3*a*. In this case, the portions without the spiral grooves correspond to the convex portions 32*b*.

In the sealing step shown in (A) of FIG. 9, the method of connecting the outer tube first intermediate-diameter portion 20 and the inner tube large-diameter portion 30 is not particularly limited. For example, a sealing member may be interposed between the outer tube first intermediate-diameter portion 20 and the inner tube large-diameter portion 30. Further, after the positioning step, the outer tube first intermediate-diameter portion 20 may be reduced in diameter and deformed to be joined to the inner tube large-diameter portion 30. In these cases, the diameter of the large-diameter sealing portion S1 refers to the average diameter of the inner diameter D1 of the outer tube first intermediate-diameter portion 20 and the outer diameter d1 of the inner tube large-diameter portion 30. The foregoing also applies to the method of connecting the outer tube small-diameter portion 21 and the inner tube first small-diameter portion 31 and the diameter of the small-diameter sealing portion S2.

The flow direction of the refrigerant in the double-tube heat exchanger 1 is not particularly limited. Regarding the inside channel 4, the refrigerant may flow in the direction from the opening 330 to the opening 310 shown in FIG. 4. Of course, the refrigerant may flow in the opposite direction. Regarding the outside channel 5, the refrigerant may flow in the direction from the second pipe 95 to the first pipe 94 shown in FIG. 4. Of course, the refrigerant may flow in the opposite direction. The flow direction of the refrigerant in the inside channel 4 and the flow direction of the refrigerant in the outside channel 5 in the spiral portion 32 are not particularly limited. The flow directions of both refrigerants may be the same (parallel flow) or opposite (counter flow). The fluid flowing through the inside channel 4 and the fluid flowing through the outside channel 5 may be the same or different. Moreover, the phase state of the fluids flowing through the inside channel 4 and the outside channel 5 is not particularly limited, and may be a gas phase, a liquid phase, or a gas-liquid two-phase.

The use of the double-tube heat exchanger 1 is not particularly limited. The double-tube heat exchanger 1 may be used for heat pump cycles (freezing cycle, cooling cycle, and heating cycle), EGR (Exhaust Gas Recirculation) coolers, oil coolers, condensers, etc. The double-tube heat exchanger 1 may also be used for binary power generation. Besides, the double-tube heat exchanger 1 may also be used to cool and warm up the batteries of electric vehicles (including hybrid vehicles, plug-in hybrid vehicles, and fuel cell vehicles).

What is claimed is:

1. A double-tube heat exchanger, comprising:

an outer tube; and an inner tube inserted into the outer tube, the double-tube heat exchanger being provided with an inside channel inside the inner tube and provided with an outside channel between the inner tube and the outer tube, and the double-tube heat exchanger being configured to exchange heat between a fluid flowing through the inside channel and a fluid flowing through the outside channel, wherein the inner tube includes an inner tube large-diameter portion, an inner tube first small-diameter portion, an uneven portion arranged between the inner tube large-diameter portion and the inner tube first small-diameter portion, and an inner tube second small-diameter portion that has a same outer diameter as the inner tube first small-diameter portion, wherein the uneven portion comprises a concave portion and a convex portion, a rear end of the uneven portion is connected to the inner tube large-diameter portion by the convex portion, a front end of the uneven portion is connected to the inner tube first small-diameter portion by the concave portion, and the inner tube second small-diameter portion and the inner tube first small diameter portion are at opposite axial end sides of the inner tube large-diameter portion, a large-diameter sealing portion is interposed between one axial end of the outer tube and the inner tube, a small-diameter sealing portion having a smaller diameter than the large-diameter sealing portion is interposed between the other axial end of the outer tube and the inner tube, and the outside channel and the uneven portion are arranged by using a difference in axial position and a difference in diameter between the large-diameter sealing portion and the small-diameter sealing portion.

2. The double-tube heat exchanger according to claim 1, wherein the outer tube includes an outer tube intermediate-diameter portion that is the one axial end of the outer tube, and an outer tube small-diameter portion that is the other axial end of the outer tube, the inner tube large-diameter portion arranged radially inside the outer tube intermediate-diameter portion, and the inner tube first small-diameter portion arranged radially inside the outer tube small-diameter portion, the large-diameter sealing portion is interposed between the outer tube intermediate-diameter portion and the inner tube large-diameter portion, and fluid-tightly seals one axial end of the outside channel, the small-diameter sealing portion is interposed between the outer tube small-diameter portion and the inner tube first small-diameter portion, and fluid-tightly seals the other axial end of the outside channel, and according to an inner diameter of the outer tube intermediate-diameter portion being D1, an inner diameter of the outer tube small-diameter portion being D2, an outer diameter of the inner tube large-diameter portion being d1, the outer diameter of the inner tube first small-diameter portion being d2, and a maximum outer diameter of the uneven portion being d3, the following formulas (1) to (3) are all established:

$$D1>D2 \quad (1)$$

$$d1\geq d3>d2 \quad (2)$$

$$D1>d2 \quad (3).$$

3. The double-tube heat exchanger according to claim 2, wherein the outer tube intermediate-diameter portion is an outer tube first intermediate-diameter portion, the outer tube includes (i) an outer tube large-diameter portion that has a larger inner diameter than the outer tube first intermediate-diameter portion, and (ii) an outer tube second intermediate-diameter portion that has the same inner diameter as the outer tube first intermediate-diameter portion, from one axial end side to the other axial end side between the outer tube first intermediate-diameter portion and the outer tube small-diameter portion, the outer tube large-diameter portion is provided with a first opening that communicates with the outside channel, and the outer tube second intermediate-diameter portion is provided with a second opening that communicates with the outside channel.

4. The double-tube heat exchanger according to claim 3, wherein one axial end of the uneven portion is arranged on the other axial end side with respect to one axial end of the outer tube large-diameter portion.

5. The double-tube heat exchanger according to claim 3, wherein the other axial end of the uneven portion is arranged on one axial end side with respect to one axial end of the second opening.

6. The double-tube heat exchanger according to claim 2, wherein the outer tube is integrally formed of the same material, and the inner tube is integrally formed of the same material.

7. The double-tube heat exchanger according to claim 1, wherein the uneven portion is a spiral portion having spiral unevenness that goes around along an outer peripheral surface of the inner tube.

8. A manufacturing method for a double-tube heat exchanger, the doble-tube heat exchanger including:

an outer tube; and an inner tube inserted into the outer tube, the double-tube heat exchanger being provided with an inside channel inside the inner tube and provided with an outside channel between the inner tube and the outer tube, and the double-tube heat exchanger being configured to exchange heat between a fluid flowing through the inside channel and a fluid flowing through the outside channel, wherein according to an insertion direction front side being a front side and an insertion direction rear side being a rear side, when the inner tube is inserted into the outer tube, the inner tube includes an inner tube large-diameter portion, an inner tube first small-diameter portion, an uneven portion arranged between the inner tube large-diameter portion and the inner tube first small-diameter portion, and an inner tube second small-diameter portion that has a same outer diameter as the inner tube first small-diameter portion, wherein the uneven portion comprises a concave portion and a convex portion, a rear end of the uneven portion is connected to the inner tube large-diameter portion by the convex portion, a front end of the uneven portion is connected to the inner tube first small-diameter portion by the concave portion, and the inner tube second small-diameter portion and the inner tube first small diameter portion are at opposite axial end sides of the inner tube large-diameter portion, a large-diameter sealing portion is interposed between a rear end portion of the outer tube and the inner tube, a small-diameter sealing portion having a smaller diameter than the large-diameter sealing portion is interposed between a front end portion of the outer tube and the inner tube, and the outside channel and the uneven portion are arranged by using a difference in axial position and a difference in diameter between the large-diameter sealing portion and the small-diameter sealing portion, the manufacturing method comprising:

inserting a front end of the inner tube into a rear end of the outer tube;

positioning the inner tube and the outer tube by moving the inner tube forward relative to the outer tube after insertion; and forming the large-diameter sealing portion by connecting the rear end portion of the outer tube and the inner tube after positioning, and forming the small-diameter sealing portion by connecting the front end portion of the outer tube and the inner tube after positioning.

9. The manufacturing method for the double-tube heat exchanger according to claim 8, wherein the outer tube includes an outer tube intermediate-diameter portion that is the rear end portion of the outer tube, and an outer tube small-diameter portion that is the front end portion of the outer tube, the inner tube large-diameter portion arranged radially inside the outer tube intermediate-diameter portion, and the inner tube first small-diameter portion arranged radially inside the outer tube small-diameter portion, the large-diameter sealing portion is interposed between the outer tube intermediate-diameter portion and the inner tube large-diameter portion, and fluid-tightly seals a rear end of the outside channel, the small-diameter sealing portion is interposed between the outer tube small-diameter portion and the inner tube first small-diameter portion, and fluid-tightly seals a front end of the outside channel, and according to an inner diameter of the outer tube intermediate-diameter portion being D1, an inner diameter of the outer tube small-diameter portion being D2, an outer diameter of the inner tube large-diameter portion being d1, the outer diameter of the inner tube first small-diameter portion being d2, and a maximum outer diameter of the uneven portion being d3, the following formulas (1) to (3) are all established:

$$D1>D2 \quad (1)$$

$$d1\geq d3>d2 \quad (2)$$

$$D1>d2 \quad (3).$$

10. The manufacturing method for the double-tube heat exchanger according to claim 9, further comprising, before the inserting, setting a tubular inner tube material in a mold, supplying a fluid into the inner tube material, expanding the inner tube material by a pressure of the fluid, and deforming the inner tube material along a mold surface of the mold, so as to expand and deform the inner tube large-diameter portion and the uneven portion with respect to the inner tube first small-diameter portion that has the same outer diameter as the inner tube material, and mold the inner tube.

11. The manufacturing method for the double-tube heat exchanger according to claim 9, wherein the outer tube intermediate-diameter portion is an outer tube first intermediate-diameter portion, the outer tube includes (i) an outer tube large-diameter portion that has a larger inner diameter than the outer tube first intermediate-diameter portion, and (ii) an outer tube second intermediate-diameter portion that has the same inner diameter as the outer tube first intermediate-diameter portion, from the rear side to the front side between the outer tube first intermediate-diameter portion and the outer tube small-diameter portion, and before the inserting, the manufacturing method further comprising:

molding the outer tube by deforming a tubular outer tube material; and forming a first opening that communicates with the outside channel in the outer tube large-diameter portion after molding, and forming a second opening that communicates with the outside channel in the outer tube second intermediate-diameter portion after molding.

12. The manufacturing method for the double-tube heat exchanger according to claim 11, further comprising, before the inserting or after the sealing, connecting a first pipe to the first opening and connecting a second pipe to the second opening.

* * * * *